US009675120B2

(12) United States Patent
Brady

(10) Patent No.: US 9,675,120 B2
(45) Date of Patent: Jun. 13, 2017

(54) MULTIFUNCTIONAL GARMENT SYSTEM AND METHOD OF USE

(71) Applicant: Shelly Brady, Tulsa, OK (US)

(72) Inventor: Shelly Brady, Tulsa, OK (US)

( * ) Notice: Subject to any disclaimer, the term of this patent is extended or adjusted under 35 U.S.C. 154(b) by 332 days.

(21) Appl. No.: 14/156,066

(22) Filed: Jan. 15, 2014

(65) Prior Publication Data

US 2014/0196188 A1 Jul. 17, 2014

Related U.S. Application Data

(60) Provisional application No. 61/752,860, filed on Jan. 15, 2013.

(51) Int. Cl.
*A41D 7/00* (2006.01)
*A41D 15/00* (2006.01)

(52) U.S. Cl.
CPC ..... *A41D 7/00* (2013.01); *A41D 15/00* (2013.01)

(58) Field of Classification Search
CPC .... A41D 15/00; A41D 15/002; A41D 13/012; A41D 7/00; A41F 1/06; A41F 1/00; A41F 9/025; A41B 11/14; A41B 11/003; A41B 1/06
USPC ..... 2/227, 236, 237, 67, 69, 228, 238, 115, 2/105, 106, 108
See application file for complete search history.

(56) References Cited

U.S. PATENT DOCUMENTS 932,640 A 8/1909 Pfiffner
1,504,249 A 8/1924 Klein
2,697,224 A 12/1954 Aidenland
3,064,265 A * 11/1962 Bridgewaters ..... A41D 15/002 2/105
4,656,669 A 4/1987 Beard
4,864,695 A * 9/1989 Gold ..... A41F 1/00 24/300
4,993,128 A * 2/1991 Gold ..... A41F 1/00 24/300
5,097,537 A * 3/1992 Ewing ..... A41B 11/003 2/239
5,119,510 A * 6/1992 Schilling ..... A01K 55/00 2/202
5,159,716 A * 11/1992 Takata ..... A41D 13/012 2/2.16
5,182,812 A * 2/1993 Goldsby ..... A61H 36/00 2/227
5,263,202 A * 11/1993 Siberell ..... A41F 1/00 2/158
5,577,306 A * 11/1996 Gold ..... A41F 1/06 24/300
5,608,915 A * 3/1997 Libit ..... A41D 1/06 2/228
5,717,999 A * 2/1998 Lurry ..... A41D 15/002 2/108

(Continued)

*Primary Examiner* — Gloria Hale
(74) *Attorney, Agent, or Firm* — Richard Mark Blank, Esq.

(57) ABSTRACT

The invention is multifunctional garment(s) and/or multifunctional garment system(s) and method(s) of using the same that comprises a first piece or a first piece and one or more additional pieces that can be removably attachable to one another in at least one fashion. The invention possesses the attribute and ability of removably forming a single article of clothing out of multiple article(s) of clothing, or vice versa, by means of the fixation of fasteners to at least one garment.

19 Claims, 33 Drawing Sheets

(56) References Cited

U.S. PATENT DOCUMENTS

| | | | | |
|---|---|---|---|---|
| 5,729,836 | A * | 3/1998 | Ewing | A41B 11/14 2/409 |
| 5,774,892 | A * | 7/1998 | Tisdale | A41D 1/06 2/115 |
| 6,185,741 | B1 * | 2/2001 | Kehoe | A41D 7/00 2/67 |
| 6,240,560 | B1 * | 6/2001 | DeCaro | A41B 9/002 2/67 |
| 6,263,509 | B1 * | 7/2001 | Bowen | A41D 13/05 2/108 |
| 8,051,496 | B2 | 11/2011 | Hersh | |
| 8,075,366 | B1 * | 12/2011 | Jaksic | A41C 3/08 2/105 |
| 2002/0029407 | A1 * | 3/2002 | Blechman | A41F 9/025 2/311 |
| 2002/0040495 | A1 * | 4/2002 | Long | B63C 11/04 2/169 |
| 2007/0169247 | A1 * | 7/2007 | Mordecai | A62B 17/006 2/81 |
| 2009/0126072 | A1 | 5/2009 | Allen | |
| 2012/0204313 | A1 | 8/2012 | Evans | |
| 2013/0291277 | A1 | 11/2013 | Kirkwood | |
| 2014/0196188 | A1 * | 7/2014 | Brady | A41D 15/00 2/67 |

* cited by examiner

MULTIFUNCTIONAL GARMENT SYSTEM AND METHOD OF USE

FIELD OF THE INVENTION

The present invention relates to multifunctional garment(s) and/or multifunctional garment system(s) and methods of use of the same, including manner(s) of use for coverings, as well as manner(s) of use for attaching devices for use, and manner(s) of use for adjusting devices for use. More specifically, the invention relates to a variety of clothing, covering and/or ornamenting materials for use by a wearer(s).

BACKGROUND OF THE INVENTION

The invention stems from the swimsuit industry where a long time trend is to use a cover up when not in the water. A more recent trend of wearing a swim shirt to protect the wearer from the sun, other natural elements, such as wind and/or rain, and/or from skin abrasions from rubbing on surf boards, and the like, also contributed to the invention. An additional recent trend of wearing a swim shirt to express one's creative and fashion sense, and to control the amount and manner of exposure of the body to the public's view, also contributed to the invention.

Often, a long time is spent searching for just the right bathing suit with the best fit and a stylish look, only to lose these attributes when covering the suit with a regular cover up or swim shirt. Also, even in the water many great looking swim suits are at a disadvantage when they are strapless or even when they have straps and exposure of the breasts is a concern, especially when engaging in water sports. In addition, exposure of skin to the sun and other natural elements is a concern due to the limited covering abilities of most conventional swimsuits in the marketplace.

The present invention seeks to remedy these problems by maintaining a bathing suit's stylish look while protecting the wearer from the sun, other natural elements, such as wind and/or rain, and/or from skin abrasions, and/or skin abrasions and other injuries from contact with surf boards, water jackets, and the like, and the surf and its surroundings, as well as accidental loss of coverage. Additionally, the present invention seeks to provide the user with an opportunity to expose specific portions of the user's body to the public's view, and to express the user's creative and fashion sense beyond that of merely choosing a bathing suit for use. All of these impairments and other impairments are addressed by various embodiments of the present invention. In addition, the present invention is a cost-effective approach to significantly improving on the current state of the art in the field of this invention.

SUMMARY OF INVENTION

It is an object of the present invention to allow for the attachment of at least one (1) piece together with another piece for the purpose of bodily coverage without the two (2) components coming apart in movement. A normal swim or active wear suit can slide around the body because there is nothing to secure such suit in place. Therefore, it is a further object of the present invention to prevent such sliding of a normal swim or active wear suit from happening. Accordingly, the present invention mitigates the chances of the wearer becoming unintentionally exposed during active sport.

Another object of the present invention is the simple and easy adjusting, connecting and/or securing, or disconnecting of at least one (1) garment to itself or at least one (1) other garment, thus allowing diversified styles. The versatility of the present invention therefore allows the wearer to easily alter the coverage and design of their outfit. Additionally, a novel method of adjusting and altering at least one (1) article of clothing on a wearer's body and attaching it to itself or at least one (1) other article of clothing is expanded by the present invention.

BRIEF DESCRIPTION OF THE DRAWINGS

FIG. 3 shows a rubberized securing elastic banding.

FIG. 7, FIG. 9, and FIG. 10 depict zippers positioned on the sides, front and/or back of either the neck or bottom of the garment(s), allowing the crops and tube tops to be put on and removed. As illustrated by these figures, zippers can be designed for one (1) side or both sides of the crop, under the arms, on the front neck portion of the top or on the back of the top neck or bottom. In addition, zippers can be incorporated onto multiple sides, or just one (1) side, of the crop top and/or the back or front of the garment(s).

FIG. 13 additionally depicts the invention using hook and eye fasteners which can also serve as the attachment and/or securing device, alone, or in conjunction with other attachment devices.

FIG. 14 depicts an embodiment of the invention without the flip over material.

DETAILED DESCRIPTION OF THE INVENTION

Figure 1:
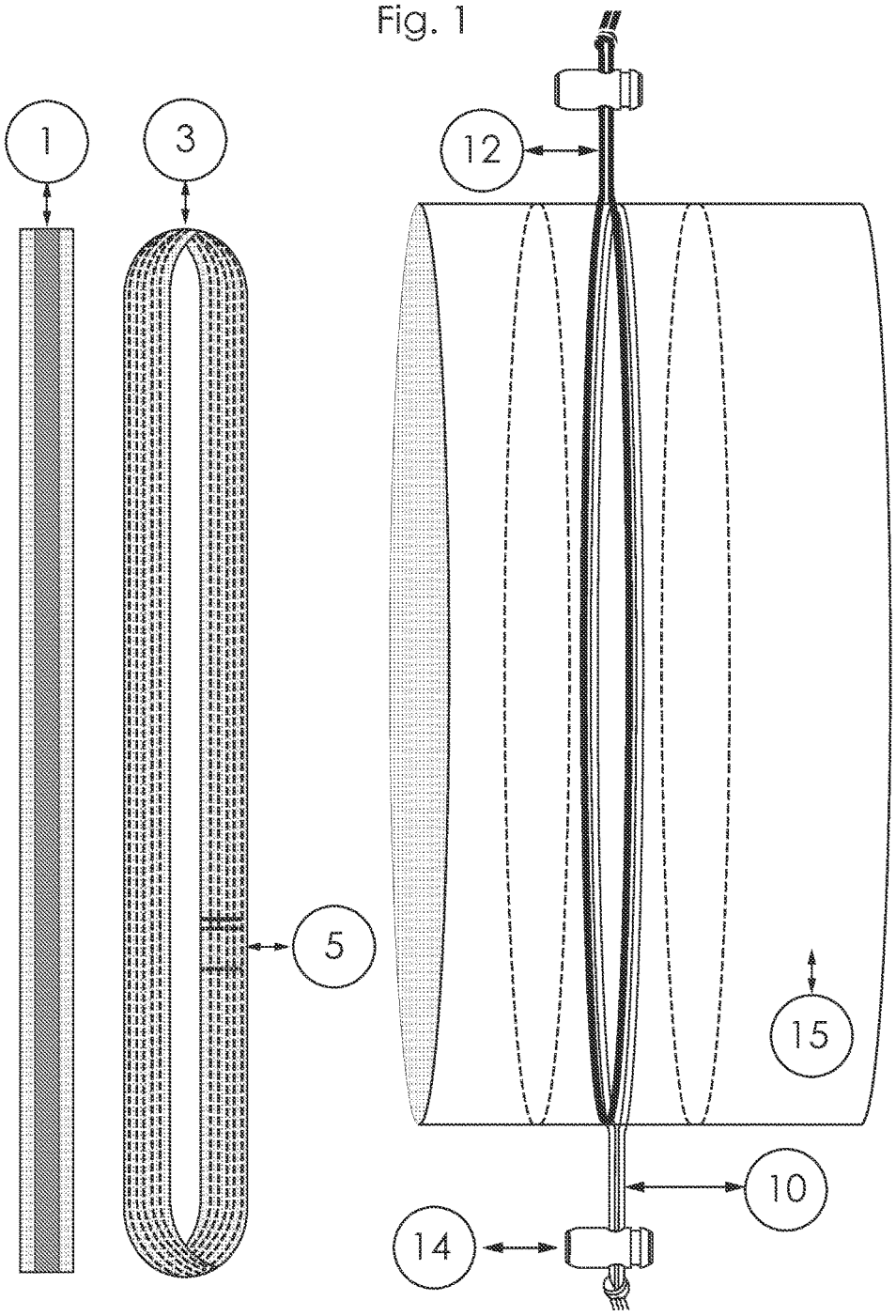
FIG. 1 shows a piece of rubber stripping, a securing strap, and two (2) drawstrings, each with toggle-type, drawstring locks.

The present invention is a multifunctional garment system that has a first piece, or a first piece and one (1) or more additional pieces, in which the one (1) or more additional pieces, when present, are situated adjacent, under, behind, on top of, in front of and/or touching the first piece. The first piece, and the one (1) or more additional pieces, when present, have at least a top section, located at or near the top thereof, and a bottom section, located at or near the bottom thereof.

It is an object of the present invention, that at least one (1) adjusting and/or tightening device, in at least one (1) of the bottom section(s) and/or the top section(s) of the first piece and/or the one (1) or more additional pieces (if present), can be drawn in tighter and/or adjusted to a wearer's body. In addition, at least one (1) of the bottom section and/or the top section of the first piece and/or the one (1) or more additional pieces can be drawn in tighter and/or adjusted to a wearer's body.

A further attribute of the present invention is that it possesses at least one (1) attaching and/or securing device located on, or in, the first piece, and/or the one (1) or more additional pieces when present, for the purpose of attaching the first piece to (one (1) or more) any additional pieces. Furthermore, the first piece and/or the one (1) or more additional pieces are capable of being worn on, and/or around, one (1) or more of a wearer's body parts or one (1) or more of a part of a wearer's body parts.

The first piece, and/or the one (1) or more additional pieces, of the present invention may be a top, crop top, t-shirt, long sleeved shirt, tank top, tube top, bandeau top, bikini top, coat, jacket, vest, suit, shirt, skirt, pair of shorts, underwear, pair of pants, pair of capris, pair of trousers, pair of knickers, pair of pedal pushers, pair of floods, pair of clamdiggers, pair of high waters, or other bottom wear, hood wear, head wear, foot wear, hand wear and/or other body wear, such as beach wear, swim wear, bathing suits, swimsuits, surf wear, convertible bathing suits, rash guards, cover ups, and sports wear.

The any one (1) or more, first pieces, and/or the one (1) or more additional pieces, may also include swim wear material that may or may not have a sun protection factor rating.

The present invention may also have at least one (1) tightening and/or adjusting device, such as a drawstring, an elastic put around outside, or elastic with a series of holes for button(s) or hook(s), a toggle, a zipper, a Velcro® fastener, a hook and loop, a material having complimentary parts, which mate to each other when brought or pressed together, such as a hook and eye, a hook, a snap, a button, a buckle, a clip, a stud, a mesh, a magnet, a stay, a twist tie, and/or an adjustable full through circle loop latch.

The multifunctional garment system with method of use may also have at least one (1) tightening and/or adjusting device that is a drawstring. Said present invention that may have at least one (1) drawstring, may also have at least one (1) drawstring locking device, which can be used to maintain the drawstring in a drawn position. The said invention may also have the at least one (1) drawstring tightening device woven into the bottom/top section of the first piece, etc. and/or the at least one (1) drawstring may be hemmed into the bottom/top section of the first piece, etc.

In addition, the present invention may have at least one (1) tightening and/or adjusting device that is at least one (1) drawstring, wherein the at least one (1) drawstring may be elastic, or any other form of flexible and/or natural and/or synthetic material, and/or the at least one (1) drawstring has a locking device.

The locking device may be a spring loaded drawstring lock, locking wheel, knot, barrel lock, toggle, and/or includes, and/or is, the at least one (1) attaching device.

The at least one (1) attaching and/or securing device may be a drawstring, elastic, toggle, zipper, zipper pull, loop, Velcro® fastener, hook and loop, material having complimentary parts that mate to each other when pressed together, hook and eye, hook, snap, button, buckle, clip, clasp, stud, mesh, magnet, stay, twist tie, adjustable full through circle loop latch and/or brad. Moreover, the at least one (1) attaching device may be positioned at the front, back, or on one (1) or more sides, and in one (1) or more places, and/or positioned throughout the entire length, diameter, circumference, or area of the top and/or bottom section(s) of the first piece, and/or the one (1) or more additional pieces, if present.

When the present invention has a first piece and one (1) or more additional pieces, the at least one (1) attaching device may be on and/or in the first piece, and the at least one (1) attaching device on, and/or in, the at least one (1) of the one (1) or more additional pieces. Furthermore, the at least one (1) attaching device on, and/or in, the first piece, and the at least one (1) attaching device on, and/or in, the at least one of the one (1) or more additional pieces, can be mated to each other.

The present invention may have at least one (1) additional securing device, on at least one (1) of the first piece and/or one (1) or more additional pieces.

A method of using the multifunctional garment system is an objective of the present invention. The method of use for the multifunctional garment system is actuated by applying a first piece and/or one (1) or more additional pieces to a wearer's body or a part thereof. The one (1) or more additional pieces are then situated adjacent and/or touching, etc. the first piece, and the one (1) or more additional pieces having at least a top section, if present, located at or near the top thereof, and a bottom section, located at or near the bottom thereof.

The method next requires the tightening and/or adjusting of at least one (1) tightening and/or adjusting device, in at least one (1) of the bottom section and/or the top section of the first piece and/or the one (1) or more additional pieces, whereby at least one (1) of the bottom section and/or the top section of the first piece and/or the one (1) or more additional pieces can be adjusted and/or drawn in tighter to the wearer's body.

It is a further object of the method that the first piece and the one (1) or more additional pieces have been applied to the wearer's body or a part thereof, attaching at least one (1) attaching device, located on or in the first piece and/or on or in the one (1) or more additional pieces, to the first piece or the one (1) or more additional pieces.

The method of using a multifunctional garment system, wherein the first piece and/or the one (1) or more additional pieces may also be applied on and/or around one (1) or more parts of the wearer's body, chest and/or upper body, midriff, hips, legs, arms, feet, hands, neck, head or part thereof, or extending past that area that it's on or around wearer's torso or bottom half.

The method of using a multifunctional garment system may additionally comprise of detaching, loosening, and/or removing.

The method of using a multifunctional garment system may also include the first piece and/or the one (1) or more additional pieces being a top, crop top, t-shirt, long sleeved shirt, tank top, tube top, bandeau top, bikini top, coat, jacket, vest, suit, shirt, skirt, pair of shorts, underwear, pair of pants, pair of capris, pair of trousers, pair of knickers, pair of pedal pushers, pair of floods, pair of clamdiggers, pair of high waters, or other bottom wear, foot wear, hand wear, and/or any swim wear material that may or may not have a sun protection factor rating.

The method of using a multifunctional garment system may also include the at least one (1) tightening device, which may be a drawstring, elastic, toggle, zipper, Velcro® fastener, hook and loop, material having complimentary parts that mate to each other when brought and/or pressed together, hook and eye, hook, snap, button, buckle, clip, stud, mesh, magnet, stay, twist tie, and/or an adjustable full through circle loop latch.

When the at least one (1) tightening device is a drawstring, the at least one (1) drawstring may have at least one (1) drawstring locking device, which can be used to maintain the drawstring in a drawn position. When the at least one (1) tightening device is a drawstring, the at least one (1) drawstring may be woven into the bottom section of the top piece, and/or the at least one (1) drawstring may be hemmed into the bottom section of the top piece.

The method of using a multifunctional garment system, wherein a tightening device may be at least one (1) drawstring, the at least one (1) drawstring may be elastic and/or the at least one (1) drawstring may be at least two (2) drawstrings and each one (1) of the at least two (2) drawstrings can have a locking device for each drawstring.

The method of using a multifunctional garment system may have the locking device be a spring loaded drawstring lock, locking wheel, knot, barrel lock, toggle, and/or includes and/or may be the at least one (1) attaching device.

The method of using a multifunctional garment system, wherein the at least one (1) attaching device may be a drawstring, elastic, toggle, zipper, zipper pull, loop, Velcro® fastener, hook and loop, material having complimentary parts which mate to each other when pressed together, hook and eye, hook, snap, button, buckle, clip, clasp, stud, mesh, magnet, stay, twist tie, adjustable full through circle loop latch and/or brad; and the at least one (1) attaching device can be positioned at the front or back, and on one (1) or more sides, at one (1) or more places, and/or throughout the entire length of the top section and/or bottom section of the first piece, and/or the one (1) or more additional pieces.

The method of using a multifunctional garment system, wherein the multifunctional garment may have a first piece and one (1) or more additional pieces that may have the attaching device on and/or in the first piece.

The method of use for the present invention may also have at least one (1) attaching device on and/or in the one (1) or more additional pieces, and the at least one (1) attaching device on and/or in the first piece. Finally, the at least one (1) attaching device on and/or in the one (1) or more additional pieces may be mated to each other.

The multifunctional garment system could be comprised of the following: a first piece or a first piece and one (1) or more additional pieces, the one (1) or more additional pieces, when present, being situated adjacent, under, behind, on top of, in front of and/or touching the first piece; the first piece and the one (1) or more additional pieces, when present, having at least a top section, located at or near the top thereof, and a bottom section, located at or near the bottom thereof; at least one (1) adjusting device and/or at least one (1) attaching device, the at least one (1) adjusting device, when present, being in at least one (1) of the bottom section and/or the top section of the first piece and/or the one (1) or more additional pieces, if present, whereby at least one (1) of the bottom section and/or the top section of the first piece and/or the one (1) or more additional pieces can be drawn in tighter and/or adjusted to a wearer's body; the at least one (1) attaching device, when present, being located on or in the first piece and/or the one (1) or more additional pieces, when present, for attaching the first piece to any additional pieces; and the first piece and/or the one (1) or more additional pieces being capable of being worn on and/or around one (1) or more of a wearer's body parts or one (1) or more of a part of a wearer's body parts.

DETAILED DESCRIPTION OF THE DRAWINGS

An example of a securing device 1 is shown in FIG. 1. In this example, the securing device 1 is a rubber strip. The strip can be placed in one (1) spot or at intervals around the top or bottom section of a multifunctional garment system ("MGS") piece or around the entire MGS piece. The securing device 1 can be made of any material that helps to secure and/or tighten an MGS piece to the body or to another MGS piece. Also, the securing device 1 does not need to be in the form of a strip, and can be in any form or shape (e.g., circular dots, squares, stars or any ornamental design, such as flowers strategically placed in one (1) or more spots or at intervals around the top or bottom section of an MGS piece or around the entire MGS piece.)

Figure 2:
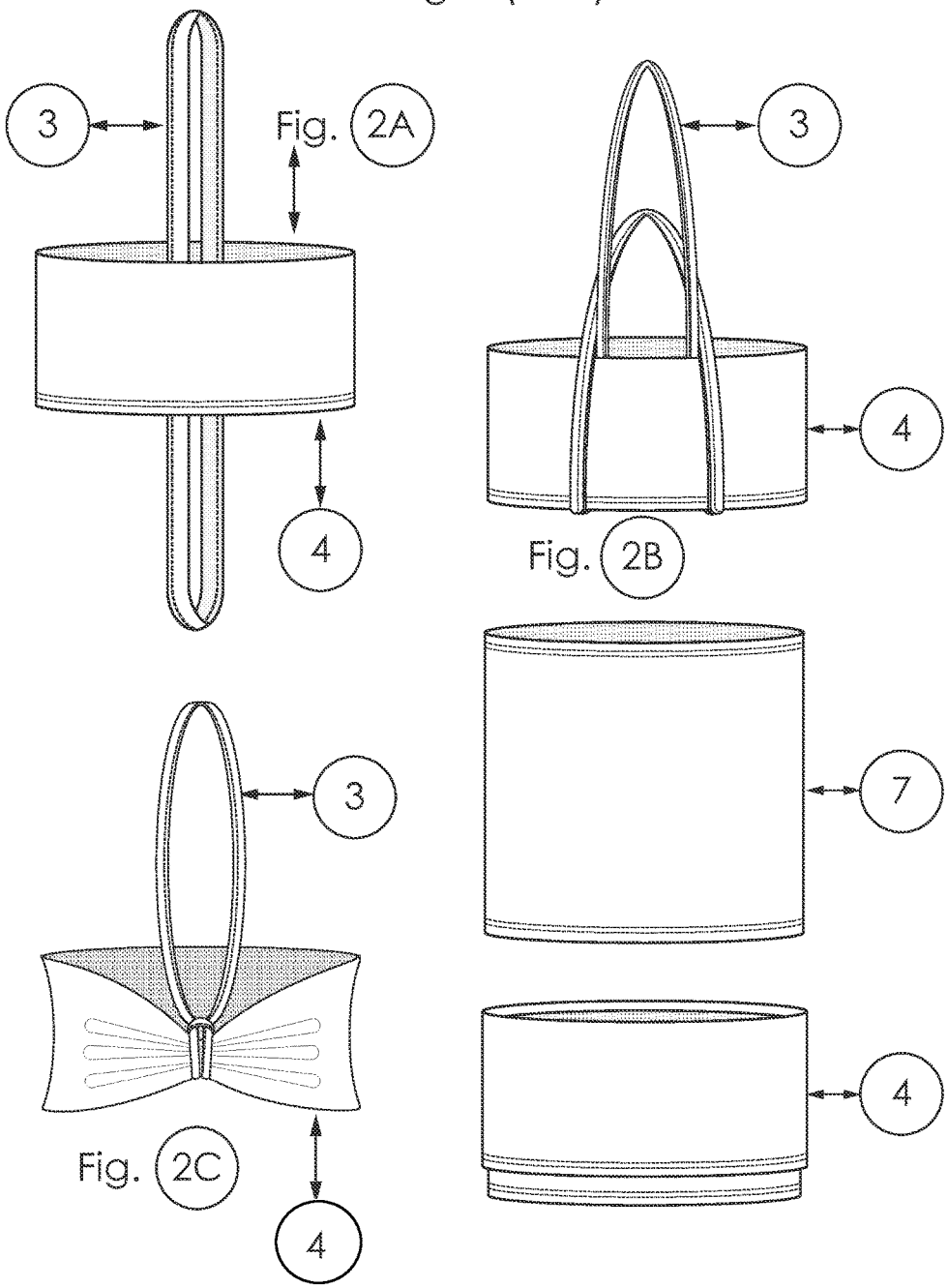
FIGS. 2(*a-c*) depict a securing strap looping through a bandeau-style top, which is used to help secure the top to the wearer's body.

An example of an attaching strap 3 is also included in FIG. 1. The attaching strap 3 can have clips at both of its ends (the ends are shown connected at point 5 in FIG. 1). By way of non-limiting example of ways to use an attaching strap 3, an attaching strap 3 can be placed around the back of a wearer's neck and the clips at the ends of attaching strap 3 can be brought around to the front of the wearer's body and clipped, or otherwise attached through some other attaching device or set device or set of mating attaching devices, on either side of the front of the bandeau-style multifunctional garment system piece 4, shown in FIG. 2. Also, the attaching strap 3 can be connected at its ends at point 5 continuous loop. Attaching strap 3 can be used to assist in attaching, securing and/or tightening an MGS piece to a wearer's body or to another MGS piece. By way of non-limiting example, an attaching strap 3 can be looped through an MGS piece, here shown as bandeau style top 4 in FIG. 2. FIG. 2 is an example of how an attaching strap 3 can be looped through a bandeau-style top 4 to help attach, secure and/or tighten the top to the wearer's body. FIG. 2*a* shows strap 3 is position to be looped through bandeau style top 4. FIG. 2*b* shows the next step with strap 3 looped on itself. FIG. 3*c* shows a loop of strap 3 around a wearer's neck as an example of a body part. Securing strap 3 or some other attaching device can be used to attach an MGS piece to other body parts as well. By way of non-limiting example, it can be used as a stirrup strap around a wearer's foot.

The attaching strap 3 can be made of any material and can be an elastic material for easier adjustment. The ends of the securing strap 3 shown at point 5 can be stitched together, as shown, or tied together. Additionally, one (1) or more of the ends of the securing strap 3 can have an attaching device for attaching it to another end of securing strap 3 or to one (1) or more MGS pieces. For example, one (1) end can have a stay 41, shown in FIG. 10, which can be used to attach it to the other end of attaching strap 3. Also, one (1) or more ends of attaching strap 3 can have an attaching device, such as a knot, or any other attaching device disclosed herein, to attach it to one (1) or more sections of an MGS piece. A knot can be used as a toggle and secured through a loop on an MGS piece. Also, each end of attaching strap 3 can have an attaching device to attach it to one (1) or more sections of an MGS piece.

Also shown in FIG. 1 are two (2) drawstrings 10 and 12 in a transparent material 15, so that the path of drawstring 10, which is light in color, can be seen separately from the path of drawstring 12, which is dark in color. Each of drawstrings 10 and 12 are shown looped through the entire length of transparent material 15 in two (2) "Big Loops," which are large enough to traverse the circumference of the body part being covered, ornamented, etc., by an MGS piece having one (1) or more drawstrings within. Also, each of drawstrings 10 and 12 are shown with toggle-type drawstring locks 14. The drawstring can be made of any material including the various materials in the definition of "drawstring" disclosed herein. Also, the drawstring lock 14 can be any item that will hold a drawstring in place, including the various items in the definition of "drawstring lock" disclosed herein. The drawstrings 10, 12 in transparent material 15 help illustrate an example of how one (1) or more drawstrings can be used in an MGS piece as an adjusting and/or tightening device.

FIGS. 2(*a-c*) depicts a securing strap looping through a bandeau-style top, used to help secure the top to the wearer's body.

Figure 3:
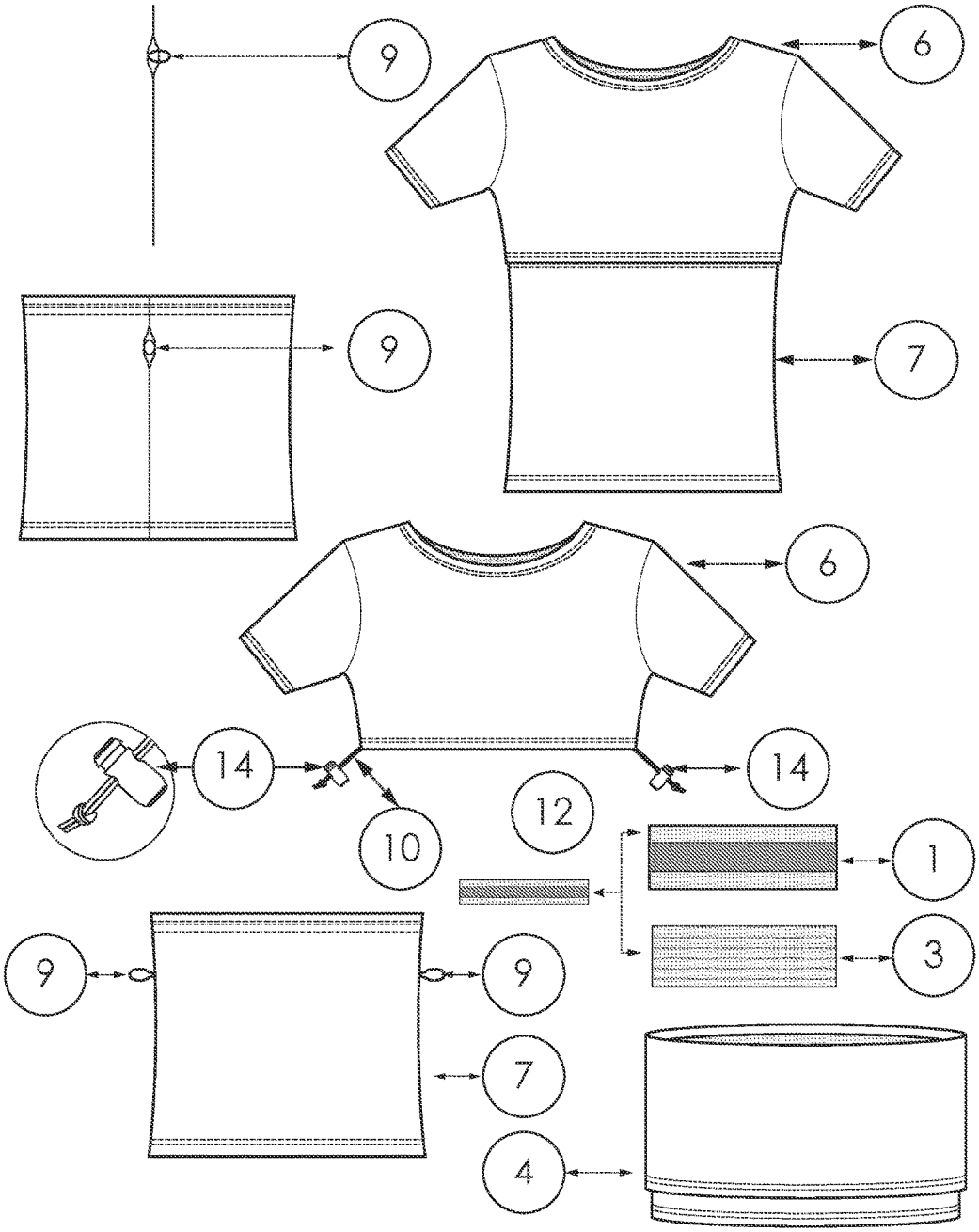
FIG. 3 shows one (1) means for securing and/or removably attaching the garments to one another, more specifically.

FIG. 3 depicts drawstrings 10, 12 in a bottom section of a crop top MGS piece 6. However, one (1) or more drawstrings can be used in any MGS piece and can be placed in any one (1) or more sections of any MGS piece. These drawstrings 10, 12 can be pulled to tighten the bottom section of the crop top MGS piece 6. The drawstring(s) 10, 12 go around the crop top MGS piece 6, so, when the crop top MGS piece 6 is worn, the drawstrings 10, 12 go around a wearer's chest. The Big Loop(s) of the drawstrings 10, 12 are pulled to adjust and/or tighten the piece to the wearers body. When the MGS piece with the one (1) or more drawstrings is to be attached to another MGS piece, pulling the drawstring(s) can also help in attaching the MGS pieces. The drawstring(s) lock(s) 14 are then slid along the drawstrings 10, 12 to secure the drawstrings 10, 12 in place. The lock(s) 14 is slid along the drawstrings 10, 12 towards the crop top MGS piece 6 and then locked against the crop top MGS piece 6.

Figure 4:
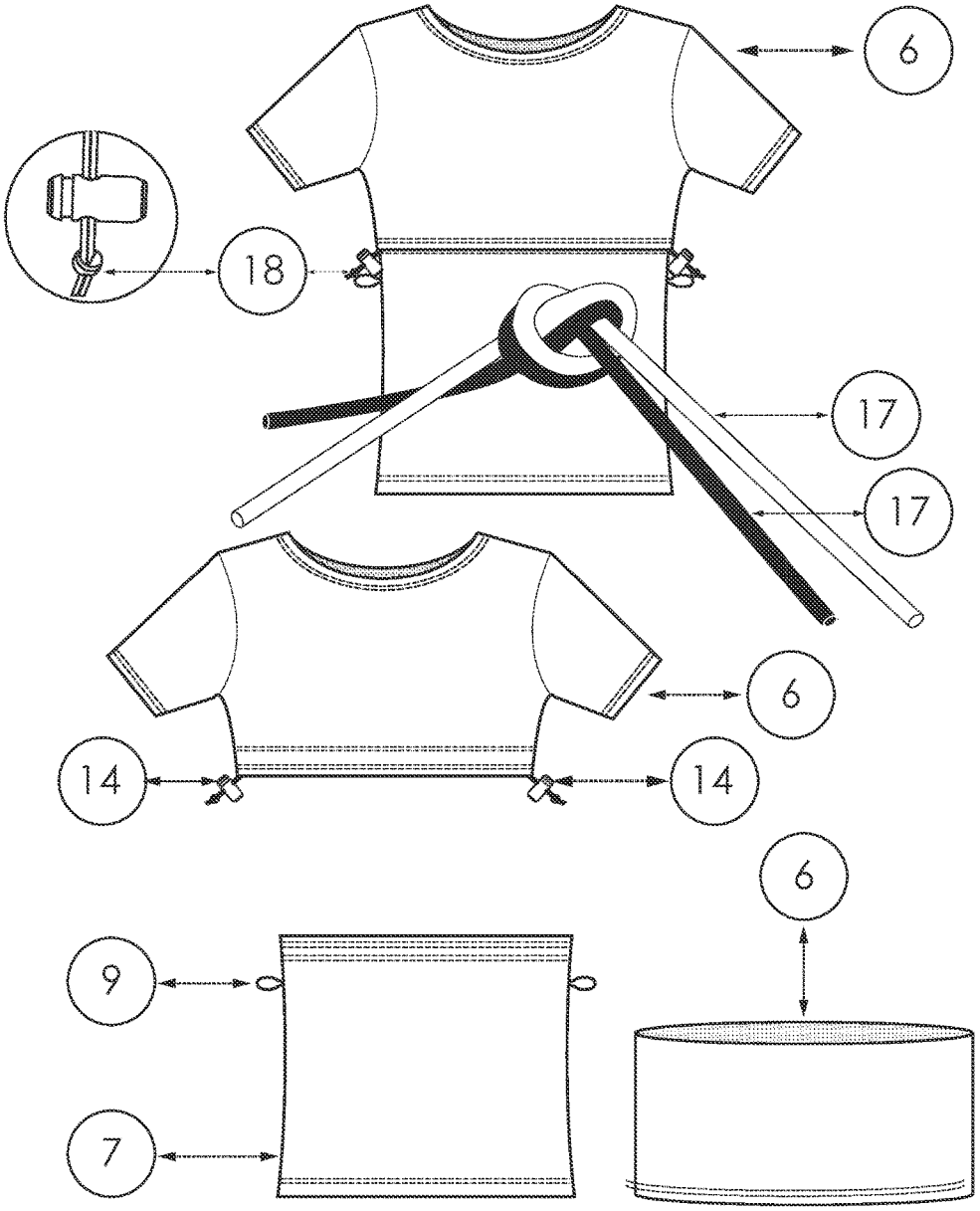
FIG. 4 is an additional illustration of the drawstring toggle elastic banding concept.
Figure 9:
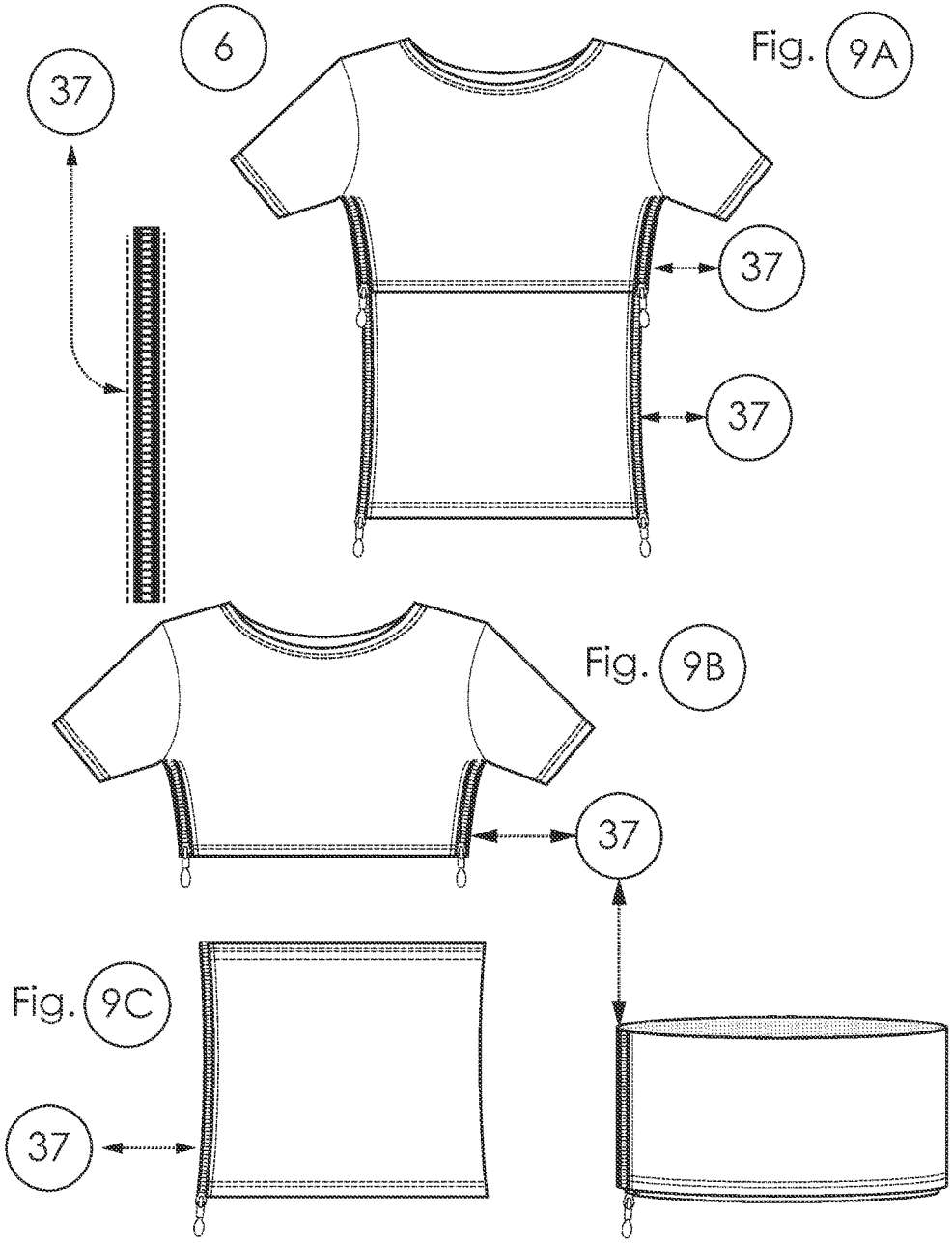
FIGS. 9(*a-c*) and FIGS. 10(*a-b*) are illustrations of the present invention utilizing zipper securing and/or attachment devices, which can be made from rubber, plastic, and/or metal.

When the wearer is also wearing tube top MGS piece 7, the tube top MGS piece 7 can be worn over the chest and/or breasts so that it is layered underneath the crop top MGS piece 6. Alternatively, the tube top MGS piece 7 can be pulled down under the wearer's chest and/or breasts so that it is below the crop top MGS piece 6. In FIG. 3, the tube top MGS piece 7 is shown with attaching loop(s) 9. The attaching loop(s) 9 can be placed anywhere on an MGS piece, e.g., front, back, sides, or multiple places along the sides, as shown in FIG. 9. The drawstring lock 14 can be used as an attaching toggle and inserted through attaching loop(s) 9 in the tube top MGS piece 7 to attach the MGS pieces together, which can be used to attach the crop top MGS piece 6 to the tube top MGS piece 7. If only one (1) drawstring 10 is used, the drawstring 10 and drawstring lock 14 are pulled tight on one (1) side of a first MGS piece and, if desired, another attaching device, or even another drawstring lock 14 can be located on the same drawstring 10, not to draw the drawstring 10, but to act as an attaching toggle to secure the first MGS piece at a point underneath both arms when an attaching loop 9 is present on both sides of a second MGS piece. The attaching loops 9 can be hidden by known or obvious to use tailoring techniques, such as hiding it under a flap, or it can be left showing for ornamentation. They can also be located near and/or aligned with and/or at or near rib cage, breast, under breast, under arm FIG. 4 includes an example of an elastic cord 17 that can be used as the drawstring(s). The elastic cord 17 includes a knot 18 that can operate as a drawstring lock and/or an attaching device.

Figure 5:
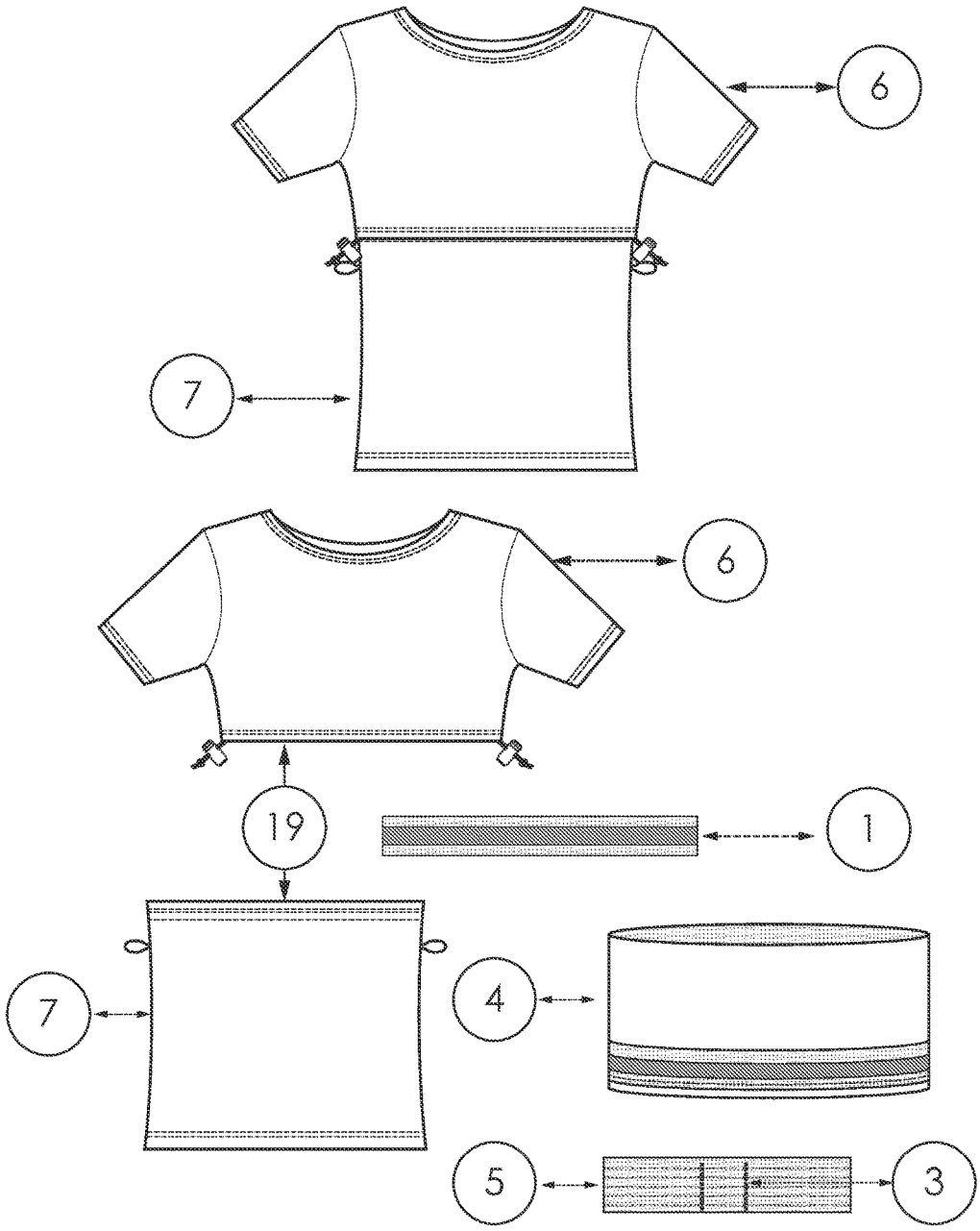
FIG. 5 depicts securing clips, which can be made from plastic, metal, and/or other natural and synthetic fibers and other materials. The clips can come in a variety of shapes, styles, colors, designs and/or sizes. These securing clips can, but are not limited or required to, attach on the sides, front and/or along the rim of the two garments interior and/or exterior of the tops, connecting both together if needed or desired.

FIG. 5 shows a piece of a rubber securing device 1. Dashed lines 19 in the bottom section of the crop top MGS piece 6 and in the top section of the tube top MGS piece 7 indicate examples of where securing device 1 can be placed, as a continuous strip or in one (1) or more pieces of a strip, on the interior and/or the exterior of the MGS pieces shown. When a securing device 1 is included on the exterior of an MGS piece, it can be ornamental in nature as well as functional. For example, pieces of rubber in a variety of shapes, such as flowers, peace signs, birds, butterflies, etc., can be placed at one (1) or more spots of an MGS piece. A securing device 1 can be used on any MGS piece(s), not just those shown in the figures. When a securing device 1 is included on the interior of an MGS piece that is worn against a wearer's body, it helps to secure that MGS piece to the wearer's body. When a securing device 1 is included on the exterior of an MGS piece, it helps to secure that MGS piece to another MGS piece. Additionally, a securing device 1 can be present on both the interior and the exterior of an MGS piece. For example, tube top MGS piece 7 in FIG. 5 includes securing device 1 in the form of a rubber strip or band along the interior of its top section. This helps to secure the piece to a wearer's body to help avoid slipping and moving. In FIG. 5, crop top MGS piece 6 includes securing device 1 in the form of a rubber strip or band along the interior of its bottom section. Then, when the wearer applies crop top MGS piece 6 over tube top MGS piece 7, the securing device 1 in crop top MGS piece 6 helps secure crop top MGS piece 6 to tube top MGS piece 7. In another example, tube top MGS piece can include a securing device at one (1) or more places along its interior and its exterior. Also, crop top MGS piece can include a securing device at one (1) or more places along its interior. Then, when the wearer applies crop top MGS piece over tube top MGS piece, the securing device in crop top MGS piece helps secure crop top MGS piece to the exterior securing device in tube top MGS piece.

Figure 6:
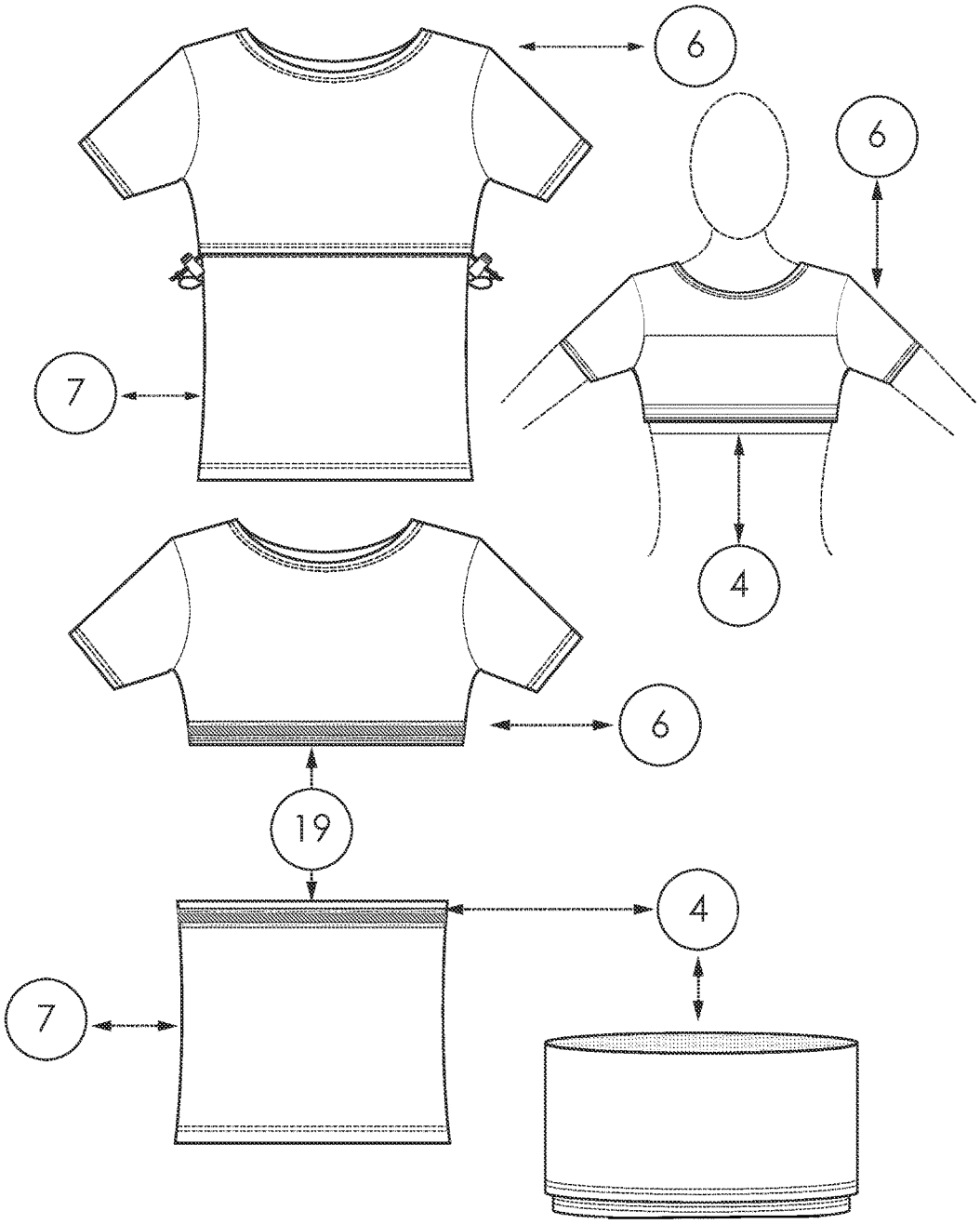
FIG. 6 depicts rubber gripper clips, which are another means of connecting both parts together, can be removed as they are rubber grippers, and can be worn on or off the garment as desired.

FIG. 6, similarly to FIG. 5, illustrates the securing device 1 on the MGS pieces, but indicates that the securing device 1 can be placed on the interior and/or the exterior of the MGS pieces.

Another feature of tube top MGS piece 7 is that, in one (1) embodiment, it can be transformed into bandeau MGS piece 4. This can be achieved in any known or obvious fashion, by way of non-limiting example, by scrunching up tube top MGS piece 7, folding it up or down and over on top of itself and the wearer's bust, folding it underneath itself, etc. Any or all MGS pieces can be made to be reversible. When an MGS piece is reversible, it can have one (1) side with different patterns, colors, materials, etc., from the other side or it can be the same on both sides.

Also depicted in FIG. 6 is one (1) embodiment in which the tube top can be positioned underneath the crop top. FIG. 6 illustrates where the tube top is worn over the breast and the crop top is worn over the tube top. The dotted line 24 indicates the positioning of the tube top on the user. In this embodiment the tube top is depicted worn under the armpits and above, and covering, the bust. The positioning of the crop top is then illustrated in this embodiment worn over the tube top, under the armpits, and over the breasts.

Figure 7:
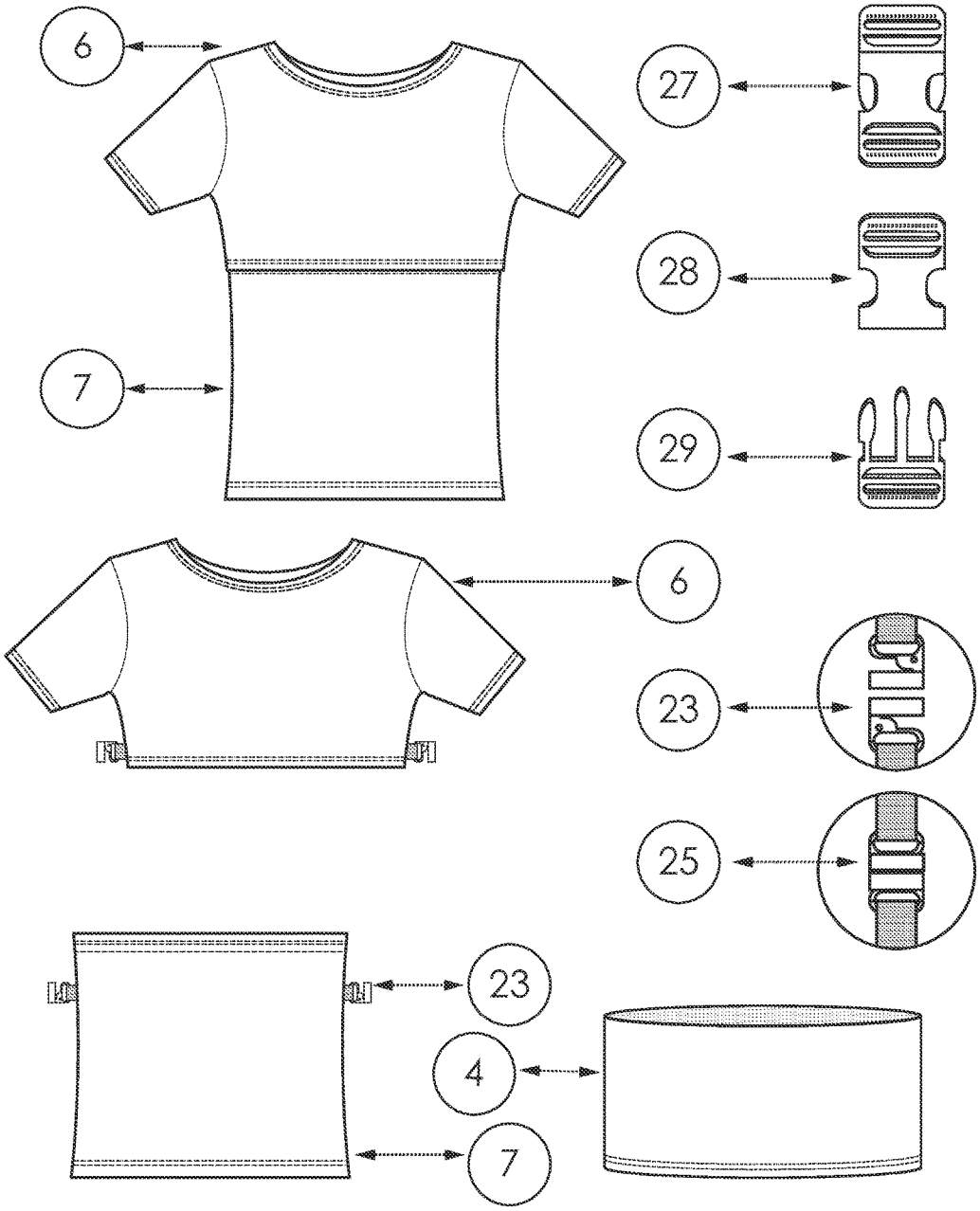
FIG. 7 depicts a small clip style closure that can also be used, individually, or in conjunction with other means of attachment, to connect the two (2) tops together. Like previously mentioned means for attachment and/or securement, these clips can be incorporated onto the side(s), perimeter(s), bottom(s), and/or the top(s) of the garment(s).

Another example of an attaching device, shown in FIG. 7, is a plastic mating removable attaching clips 23. Removable attaching clips 23 can also be made from other materials, such as wood, metal, natural and/or synthetic fibers, etc. When the type of clips shown in FIG. 7 are used, each of the MGS pieces to be connected can include at least one (1) attaching clip 23, with one mating attaching clip 23 being on one (1) of the MGS pieces and its mate attaching clip 23 being on the other MGS piece. Attaching clips 23 are attached by mating or clipping them together to form 25. Also, when the type of clips shown in FIG. 7 are used, only one (1) of the MGS pieces to be connected can include at least one (1) attaching clip 23, with the other MGS piece having a loop for the clip to go through.

Another example of an attaching device, also shown in FIG. 7, is a plastic removable attaching buckle 27. The removable attaching buckle 27 can also be made from other materials, such as wood, metal, synthetic and/or natural fibers, etc. When this type of buckle is used, each of the MGS pieces to be connected include at least one (1) end of attaching buckle 27, with one (1) mating attaching buckle end 27 being on one (1) of the MGS pieces and its mate attaching buckle 27 being on the other MGS piece. The ends of attaching buckle 27 are attached by inserting male buckle end 28 into female buckle end 29.

Figure 8:
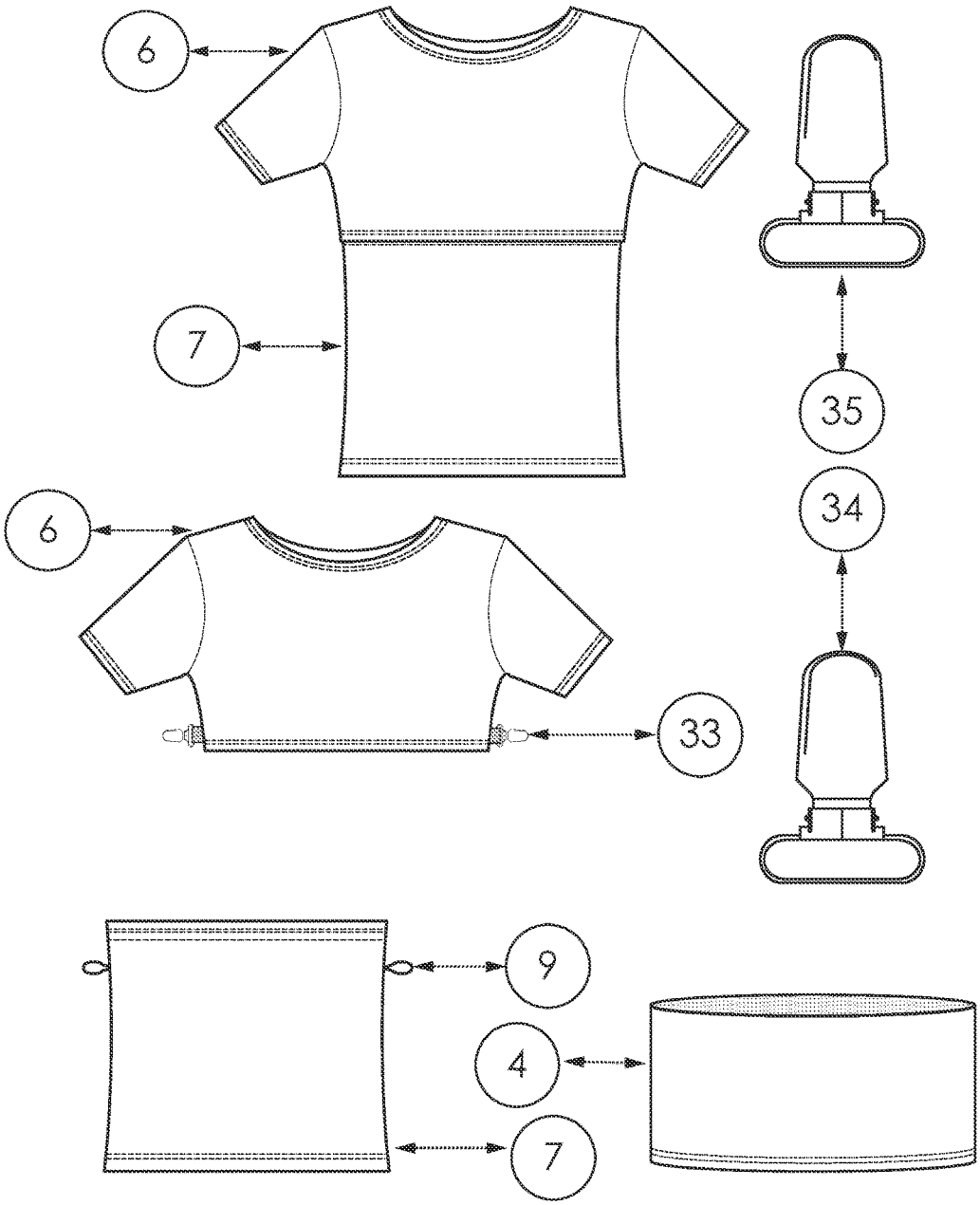
FIG. 8 depicts another style of clip fashion attachment and/or securing devices to connect the garment(s) together. These clip fashion attachments and securing devices can be an obvious or hidden within the design.

FIG. 8 shows another example of an attaching device, a metal attaching clip 33. The attaching clip 33 can also be made from other materials, such as wood, metal, natural fibers, etc. When this type of clip is used, only one (1) of the MGS pieces to be connected includes attaching clip 33, although both MGS pieces can include such a clip. This type of clip works by attaching its non-clamping end 34, shown here as a loop, to one (1) MGS piece (and any known or obvious means can be used to attach it, releasably or permanently, such as releasably strapping it, sewing it, using a stud, rivet, button, snap, etc.). Then, the clamping end 35 can be used to clamp attaching clip 33 onto another MGS piece. It is only necessary for one (1) MGS piece to include attaching clip 33, since its non-clamping end 34 can be attached to one (1) MGS piece and its clamping end 35 can be available to clamp/clip on to any other MGS piece. However, either or both MGS pieces can include one (1) or more attaching clip 33. It is also possible to have the non-clamping end 34 of a first attaching clip 33 on one (1) side (in one (1) place) of a first MGS piece and attach its clamping end 35 to a second MGS piece on that same side of the wearer, and to have the non-clamping end 34 of a second attaching clip 33 attached to another side of the second MGS piece and attach its clamping end 35 to the first MGS piece, with the clip being clamped on that same side of the wearer.

FIGS. 9(*a-c*) and 10(*a-b*) illustrate the use of zipper(s) 37 on either or both MGS pieces. Zipper(s) 37 can be made of any suitable material, such as plastic, metal, nylon, rubber, etc. Zipper(s) 37 can be used as an attaching device and/or a tightening and/or adjusting device. When zipper(s) 37 is closed, it pulls together all or part of an MGS piece (depending on whether the zipper zips through all or part of the MGS piece) and tightens it to the wearer's body. Conversely, when zipper(s) 37 is opened, it separates all or part of an MGS piece (depending on whether the zipper zips through all or part of the MGS piece) and loosens it from the wearer's body. Zipper(s) 37 does not need to be opened or closed all the way to have an adjustment effect. In this example the adjustment effect is a tightening or loosening effect at the wearer's sole discretion.

FIGS. 9*a* and 9*b* show that zipper(s) 37 can be on both sides of both MGS pieces, which are attached together. It is also possible to continuously or semi-continuously zip from one MGS piece to another, whereby zipper(s) 37 can operate as an attaching device as well as an adjusting device. Also, it is possible that either, not both, attached MGS pieces include a zipper, or that only one zipper is included in one or both of the MGS pieces. Also, although zipper(s) 37 are shown under the arms of the MGS pieces, zipper(s) 37 can be located anywhere on one or more MGS piece, and it might be ornamental to have the zipper(s) 37 in the front and/or back of one or more MGS piece. When the zipper zips through an entire MGS piece, such as shown in FIG. 9*c*, the zipper is being used to apply the MGS piece to a wearer's body, as well as adjust it, and, if it zips into another a MGS piece, it also acts to attach it. A vertical column, horizontal row, diagonal, zig-zag or some other design of a series, of buttons, snaps, hook and eyes or other adjustment devices can be used the same way as the zipper(s) 37 in these examples.

FIG. 9*c* also shows zipper(s) 37 on only one (1) side of an MGS piece. The zipper(s) 37 can be on both sides, as shown in FIG. 9*a*. Alternatively, the MGS piece might not have a zipper at all, although zippers offer easy access and/or style.

Figure 10:
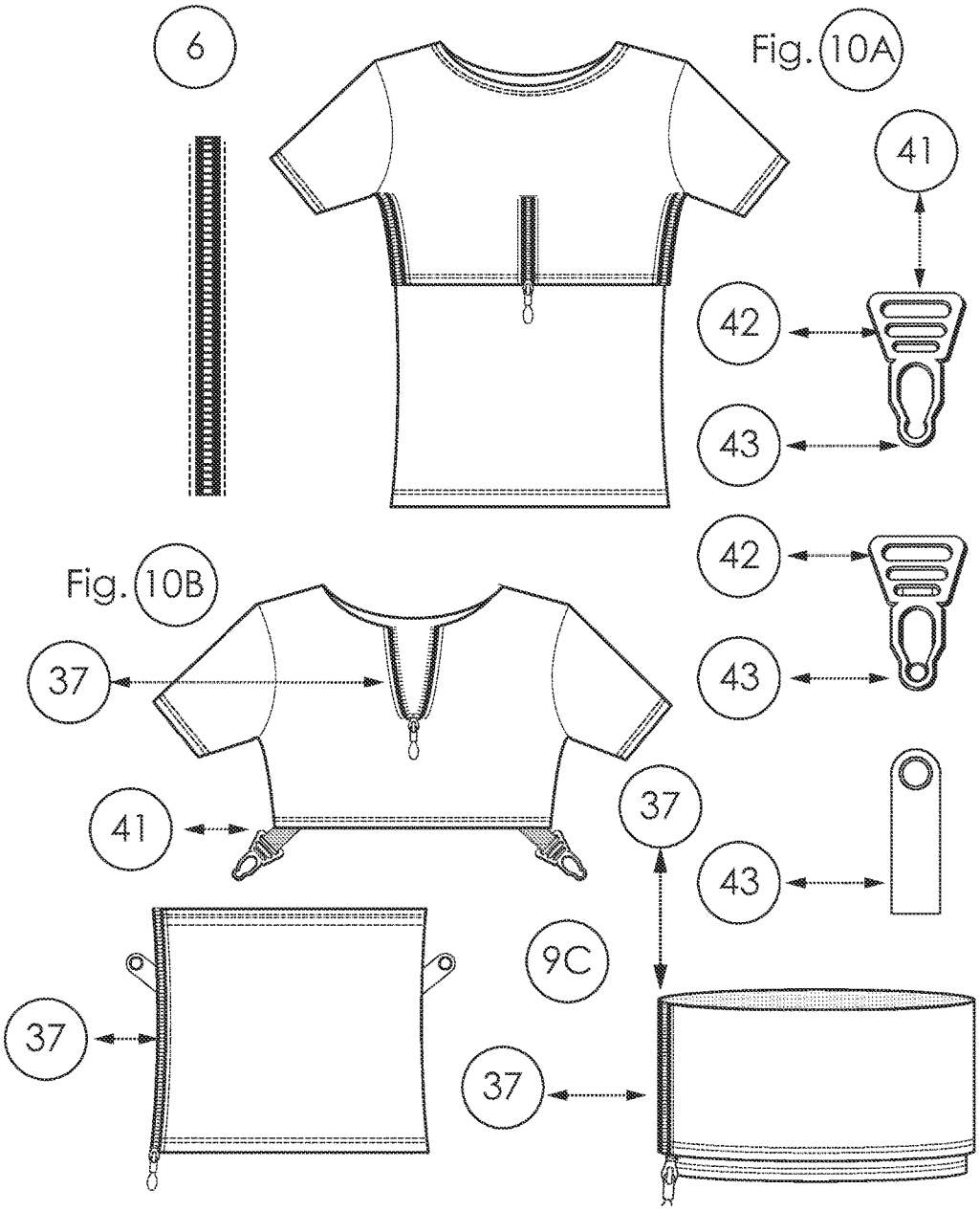

As shown in FIG. 10, zipper(s) 37 can be in the bottom section, FIG. 10*a*, or top section, FIG. 10*b*, of an MGS piece, as well as the zipper being through the entire length of the piece, as shown in FIG. 9*c*, or part or the entire width of the piece. Also, the zipper(s) 37 in FIGS. 10*a* and 10*b* can be in either or both the front, back, or other locations of an MGS piece. A series of buttons, snaps, hook and eyes or other adjustment devices can be used the same way as the zipper(s) 37 in these examples. Also, zipper(s) 37, as well as buttons, snaps, hook and eyes or other adjustment devices can be used horizontally across all or part of an MGS piece.

FIG. 10 also includes a photograph of metal stay(s) 41. Stay(s) 41 can be used as an attaching device to attach an MGS piece, or as an adjusting device, e.g., a stay on one (1) MGS piece can be clipped to that same MGS piece to make it tighter. Attaching clip 33 can also be used as an adjusting device in this manner. The stay(s) 41 can also be made from other materials, such as wood, plastic, rubber, natural and/or synthetic fibers, etc. When a stay is used, only one (1) of the MGS pieces to be connected include a stay 41, although both MGS pieces can include such a stay. A stay works by attaching its non-clamping end 42, shown here with three (3) open spaces to serve as point(s) of attachment, to one (1) MGS piece (and any known or obvious means can be used to attach it, releasably or permanently, such as releasably strapping it, sewing it, using a stud, rivet, button, snap, etc.). Then, the clamping end 43 can be used to clamp stay 41 onto another MGS piece. It is only necessary for one (1) MGS piece to include stay(s) 41, since its non-clamping end 42 can be attached to one (1) MGS piece and its clamping end 43 can be available to clamp/clip on to any other MGS piece. However, either of both MGS pieces can include one (1) or more attaching stay(s) 41. It is also possible to have the non-clamping end 42 of a first stay 41 on one (1) side of a first MGS piece and attach its clamping end 43 to a second MGS piece on that same side of the wearer, and to have the non-clamping end 42 of a second stay 41 attached to another side of the second MGS piece and attach its clamping end 43 to the first MGS piece, with the clip being clamped on that same side of the wearer.

Figure 11:
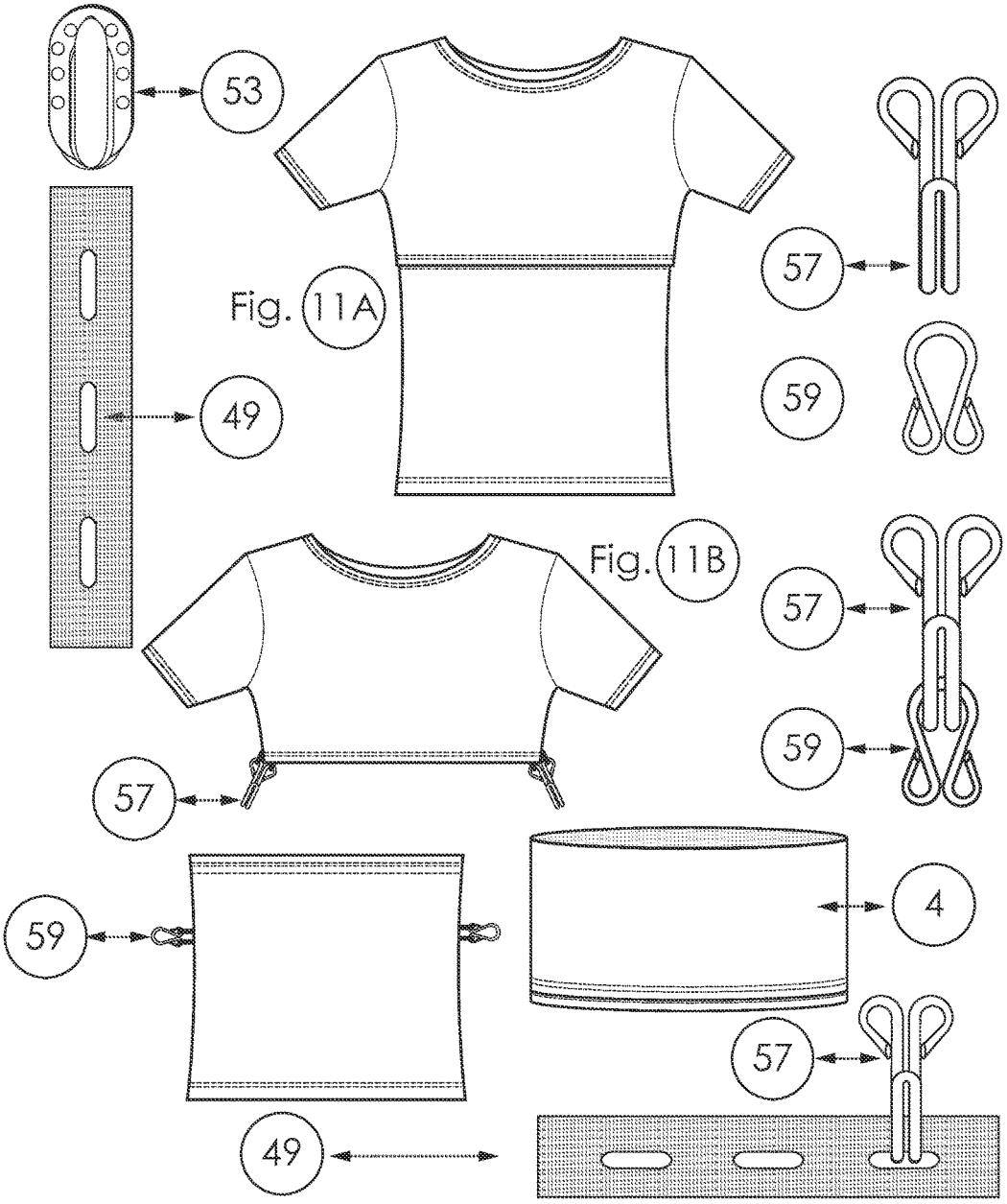
FIGS. 11(*a-b*) depict a hook with hole style of attachment device. As depicted in this figure, these attachments and/or securing devices can be incorporated vertically or horizontally into the design. These devices may comprise elastic holes for securing hooks on the rim of the sides of the top, either vertically or horizontally. The design can be made as part of the styling or hidden by sliding into the interior of the top seam of the tube and bottom seam of the crop into the interior behind a hidden flap.

FIG. 11 depicts various adjustment and/or attachment devices. A material with openings 49 can be used together with various devices that fit, clip, hook, button, etc. into the openings. Examples of the material for making the material with openings 49 include, but are not limited to, elastic, other fabrics, such as cotton, wool, polyester, etc., rubber, plastic, metal, etc., and it can be of any shape. The material with openings 49 can include any type of openings of any shape, such as holes, slits, etc. The type and shape of the material and the openings can, in some cases, depend on the mating device to fit into the openings.

One (1) type of device that hooks into the openings of the material with openings 49 is metal hook 53. The hook 53 can also be made from other materials, such as wood, plastic, rubber, natural fibers, etc. When this combination of hook 53 and material with openings 49 is used, each of the MGS pieces to be connected usually includes at least one (1) of either the hook 53 or the material with openings 49. The first MGS piece to be attached includes at least one (1) of either the hook 53 or the material with openings 49, and the second MGS piece to be attached includes at least one (1) of the mating hook 53 or the mating material with openings 49, so that the first and second MSG pieces can be attached to each other by hooking hook 53 into one (1) of the openings in the material with openings 49. This combination can also be used as an adjusting device where both hook 53 and the material with openings 49 are on the same MGS piece so that when they are hooked together, they can make that MGS piece tighter or shorter, depending whether they are hooked together laterally, which can adjust it tighter, or longitudinally, which can adjust the length.

Another example of a type of device that hooks into the openings of the material with openings 49 is fabric hook 57. The hook 57 can also be made from other materials, such as wood, metal, plastic, rubber, natural fibers, etc. When this combination of hook 57 and material with openings 49 is used, each of the MGS pieces to be connected usually includes at least one (1) of either the hook 57 or the material with openings 49. The first MGS piece to be attached includes at least one (1) of either the hook 57 or the material with openings 49, and the second MGS piece to be attached includes at least one (1) of the mating hook 57 or the mating material with openings 49, so that the first and second MSG pieces can be attached to each other by hooking hook 57 into one (1) of the openings in the material with openings 49. This combination can also be used as an adjusting device where both hook 57 and the material with openings 49 are on the same MGS piece so that when they are hooked together, they can make that MGS piece tighter or shorter, depending whether they are hooked together horizontally, which can adjust it tighter, as shown in FIG. 11*a*, or vertically, which can adjust the length, as shown in 11*b*.

There are other types of devices that hook or otherwise go into the openings of the material with openings 49 and can be used instead of or in addition to hook 53 or hook 57. Examples include, but are not limited to, other hooks, buttons, snaps, studs, toggles etc.

FIG. 11 also shows another adjustment and/or attachment device in the combination of fabric hook 57 and fabric eye 59. As noted above, hook 57 can also be made from other materials, such as wood, metal, plastic, rubber, natural and/or synthetic fibers, etc. Also, fabric eye 59 can be made from other materials that can form a loop, such as thread, fabric, metal, wood, plastic, rubber, natural fibers, etc. When this combination of hook 57 and eye 59 is used, each of the MGS pieces to be connected usually includes at least one (1) of either the hook 57 or the eye 59. The first MGS piece to be attached includes at least one (1) of either the hook 57 or the eye 59, and the second MGS piece to be attached includes at least one (1) of the mating hook 57 or the mating eye 59, so that the first and second MSG pieces can be attached to each other by hooking hook 57 into eye 59. This combination can also be used as an adjusting device where both hook 57 and eye 59 are on the same MGS piece so that when they are hooked together, they can make that MGS piece tighter or shorter, depending whether they are hooked together horizontally to adjust it tighter, or vertically to adjust the length. Generally, in hook and eye closures, either one (1) or both of the hook and eye are hidden.

Figure 12:
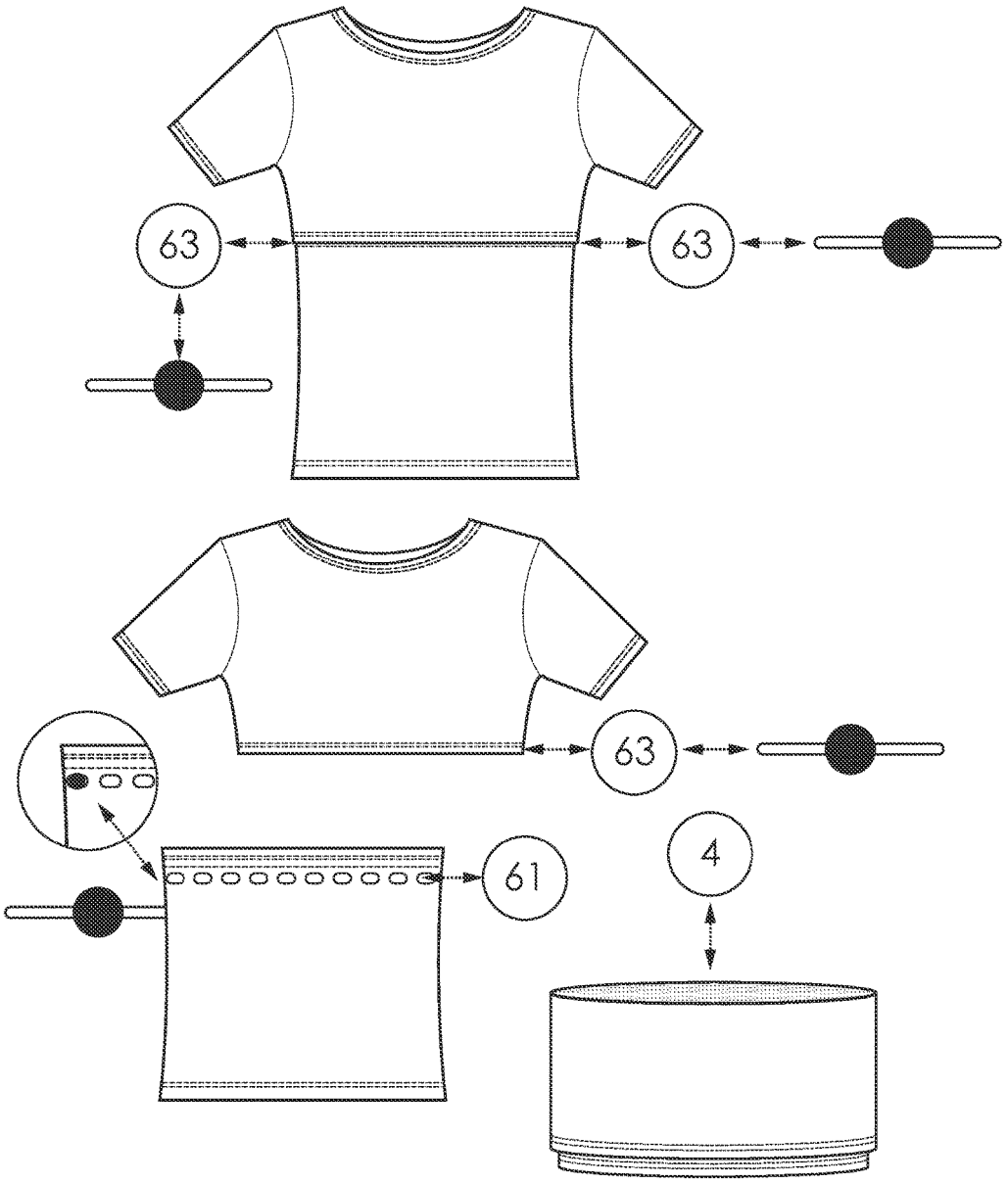
FIG. 12 is an example of the present invention utilizing studs and brad style attachments and securing devices. This design allows the tops to be attached to the crop or tube through holes in at least one (1) of the tops in which brads, buttons, or decorative charms, can insert and connect the two tops together.

In FIG. 12, the MGS piece itself acts like the material with openings 49 in FIG. 11. The MGS piece itself has one (1) or more openings, holes or slits 61 through which a stud(s) or brad(s) 63 can be secured to attach and/or adjust two (2) MGS pieces or to adjust one (1) MGS piece having both a stud(s) and/or brad(s) 63. The openings can be in any size or shape to fit the complimentary/mating brad or stud. Slits or holes are simple openings, but more complex and/or decorative openings are also useful. For example, openings in the shape of stars, hearts, butterflies, moons, sun bursts, etc. can be used whether the head of the stud or brad is the same shape as the opening or not. In this way, both the openings and the brads/studs can have a decorative effect. Additionally, the holes can include reinforcing and/or decorative rivets. Also, studs and brads can be further ornamented by gems, rhinestones, enamel, etc. for an additional decorative effect. Further, studs an brads can be made from a variety of materials, such as, metal, plastic, wood, rubber, fabric, natural and/or synthetic fibers, etc.

In practice, the stud(s) is usually attached to one (1) of the MGS pieces and the opening(s) is in another MGS piece to which it is to be attached and/or adjusted. When a stud and an opening are in the same MGS piece, the combination can also be used for adjusting the MGS piece. On the other hand, when using a brad(s), the opening(s) is usually in at least one (1) of both of the MGS pieces to be attached and the brad(s) is inserted through both openings and split, separated and/or extended to secure it. The opening does not have to be in both of the MGS pieces. Instead, the opening can be in something attached to the MGS piece, such as 67*a* in FIG. 13.

Figure 13:
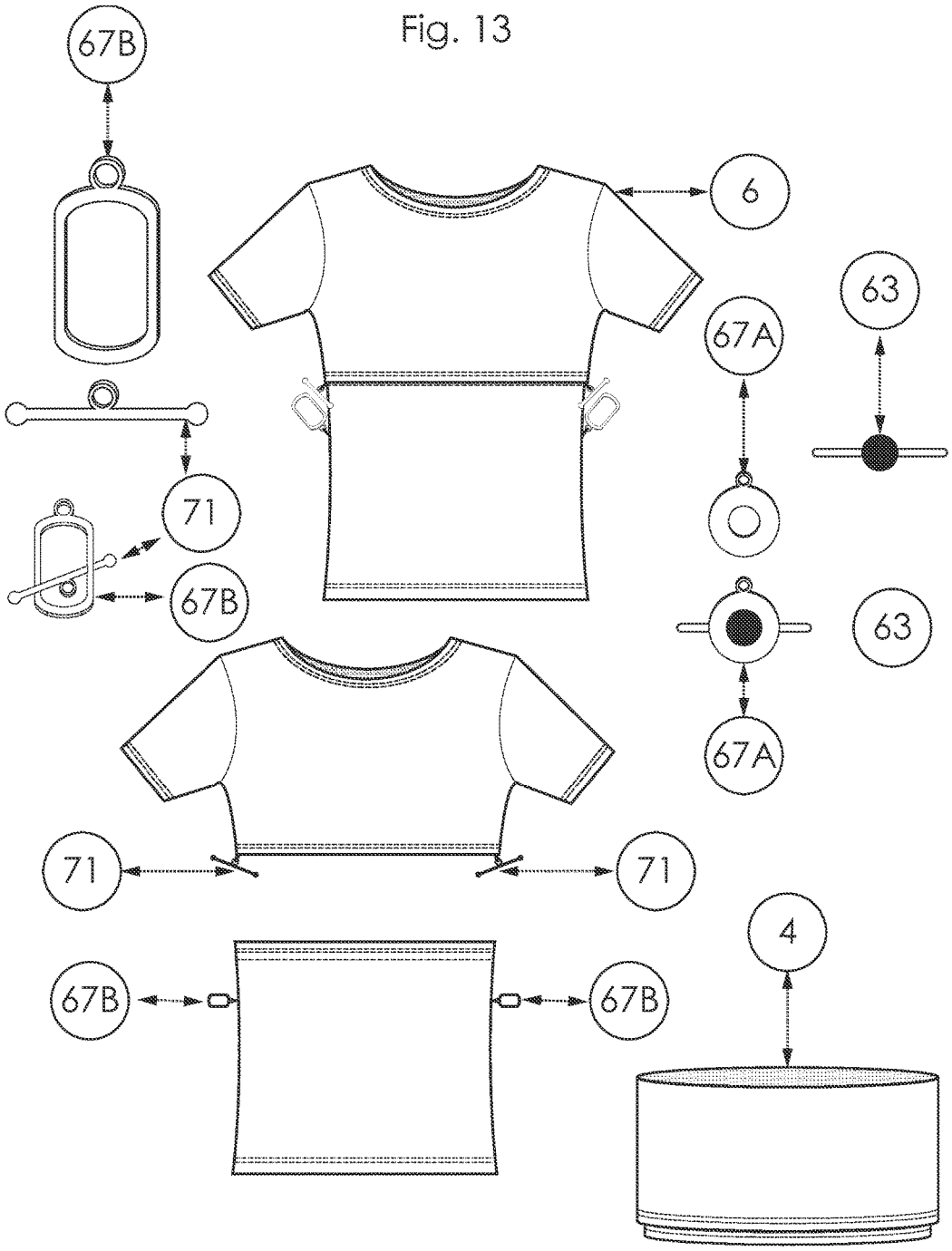
FIG. 13 depicts the invention using toggles and hooks and eyes as the means for the securing and/or attachment device. The toggle closures are made with the toggle in either the top crop or bottom of the tube top, allowing the connection of both together if required or desired.

FIG. 13 shows a brad 63 being used for as a toggle together with toggle closure 67*a*. The toggle closure 67*a* can be made in a variety of shapes and from a variety of materials. Another shape of toggle closure 67*b* is also shown in FIG. 13, together with a pin or rod-shaped toggle 71. This combination of toggle 71 and toggle closure 67*b* is easy to hide, but the toggle closure 67*a*, like the toggle closure 67*b*, can also be shown for a decorative effect and/or as part of a design. One (1) example is to include one (1) or more toggle closures 67*b* under the bust line of a tube top MGS piece. The toggle closure(s) 67*b* would have a decorative effect on the MGS piece, but also be useful as an attaching and/or adjusting device. For example, a crop top MGS piece can include toggle 71 in the bottom section thereof where it will end up adjacent to toggle closure 67*b* when the crop top MGS piece is applied over the tube top MGS piece. Then, the toggle(s) 71 can be placed in the toggle closure(s) 67*b* to attach and/or adjust the two (2) MGS pieces.

Figure 14:
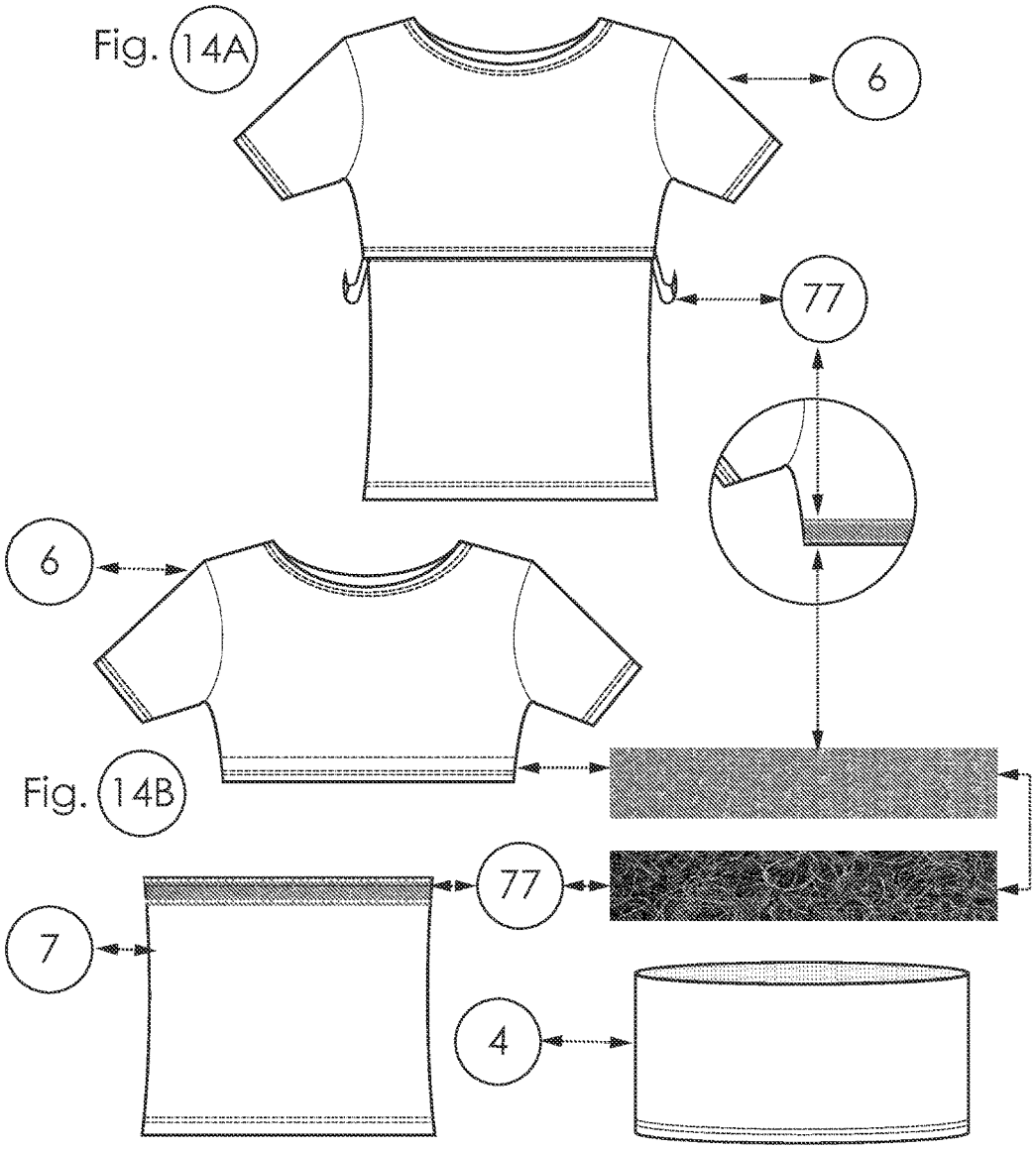
FIGS. 14(*a-b*) depict the invention utilizing Velcro strips with a material flap that hides and protects the Velcro and the suit.

FIGS. 14(*a-b*) illustrates the use of rubber, rubber stripping, Velcro®, and/or Velcro® and/or zip-together-style adhering strip(s) 77 to adjust and/or attach one or more MGS pieces. Other types of adhering strip(s) can be used, for example tape, adhesive, releasable tape, releasable adhesive, etc. The adhering strip(s) 77 functions similarly to zipper(s) 37 in FIGS. 9 and 10, and can be placed in similar positions on one or more MGS piece. FIG. 14*a* shows the use of Velcro® adhering strip(s) 77 in the side slits of an MGS piece. When the mating/complimentary Velcro® strips are connected, they operate to adjust the tightness of the MGS piece.

The adhering strip(s) 77 can be used to adjust and/or attach one (1) or more MGS pieces. In addition to being placed on both sides of an MGS piece as shown in FIG. 14*a*, adhering strip(s) 77 can be placed on only one (1) side, or part of one (1) side, or part of both sides of one (1) or more MGS pieces. The adhering strip(s) 77 can also be placed in the front and/or back of one (1) or more MGS pieces, placed through the entire length of one (1) or more MGS pieces, or only through a top and/or bottom portion thereof as shown for zipper(s) 37 in FIGS. 10*a* and 10*b*. Also, as shown in FIG. 14*b*, complimentary adhering strips 77 can be placed around the circumference of two (2) MGS pieces to be connected. Actually, one (1) or more adhering strips 77 can also be placed at one (1) or more intervals around the circumference of an MGS piece.

In the example shown in FIG. 14*b*, complimentary adhering strips 77 are in the front, back or entire circumference of the top portion of tube top MGS piece 7 and the bottom portion of crop top MGS piece 6. FIG. 14*b* shows the location of adhering strip 77 in the top of the top portion of tube top MGS piece 7. However, one (1) or more adhering strip(s) 77 can be placed anywhere in the top or bottom portion of any MGS piece, both of which can include a middle portion where the top overlaps the middle and where the bottom overlaps the middle. In one (1) example, one (1) or more adhering strips 77 are placed under the bust line of tube top MGS piece 7 at one (1) or more intervals around the circumference of the MGS piece, whereby the bust is covered by both tube top MGS piece 7 and crop top MGS piece 6.

In another example, one (1) or more adhering strip(s) 77 can be used to vertically attach two (2) MGS pieces as shown for zipper 37 in FIG. 9*a*, as opposed to horizontally as shown in FIG. 14*b*. Vertical attachment can be achieved, for example, by overlapping one (1) or more adhering strip(s) 77 on one (1) MGS piece with one (1) or more adhering strip(s) 77 on another MGS piece. In another example, the one (1) or more adhering strip(s) 77 can be extended past the material of the MGS piece and the extension part of the adhering strip 77 can be attached to an adhering strip in another MGS piece in addition to or instead of the main section of the adhering strip 77 being the attaching device. It is also possible to use an adhering strip 77 on one (1) of the MGS pieces and attach the adhering strip 77 directly to the material of another MGS piece.

The one (1) or more adhering strip(s) 77 can be hidden in any known or obviously practical manner so that the one (1) or more adhering strip(s) 77 are not visible and/or so the one (1) or more adhering strip(s) 77 do not interfere with other sections of fabric on same or another MGS piece. One (1) example is to cover the one (1) or more adhering strip(s) 77 with a flip over material. The one (1) or more adhering strip(s) 77 can be used with or without a securing device 1.

Figure 15:
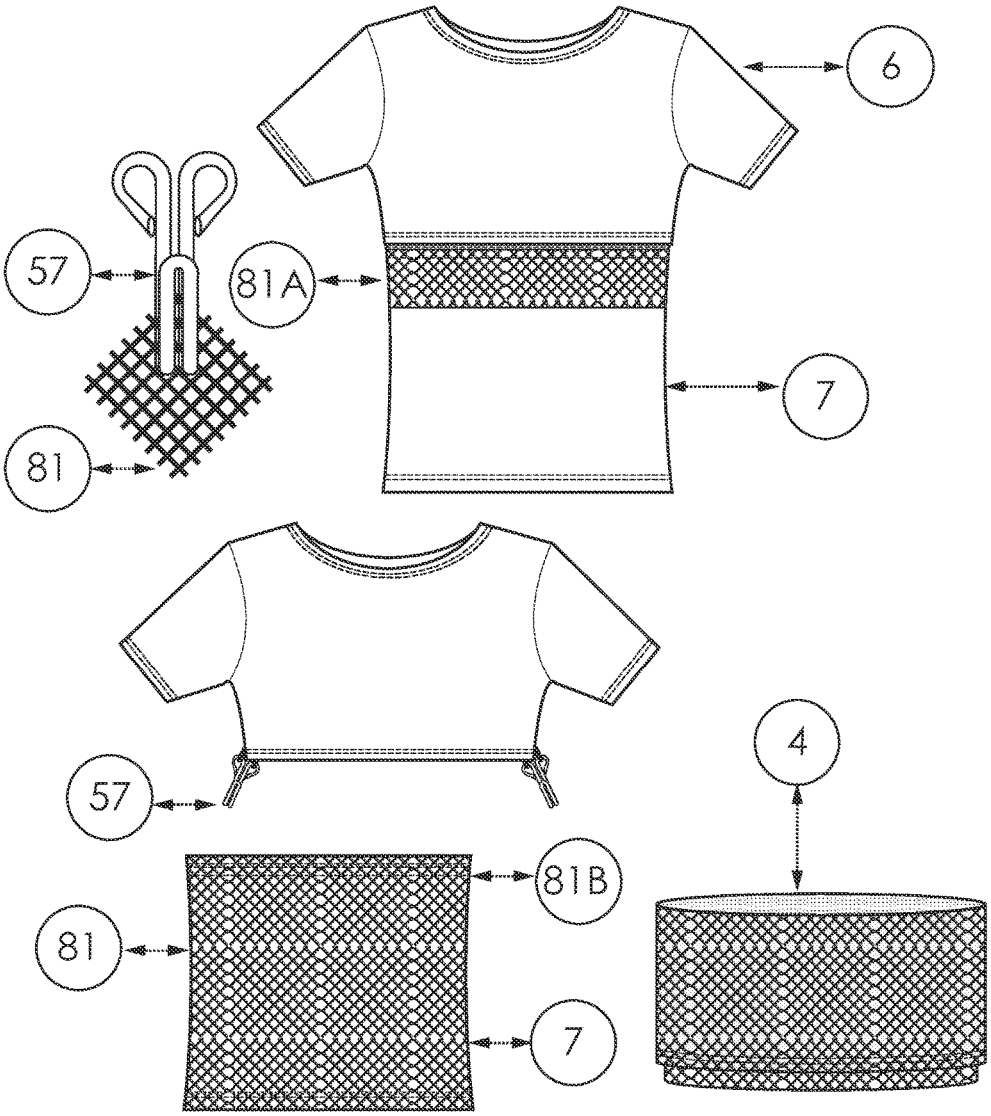
FIG. 15 depicts an embodiment of the invention utilizing a mesh design with hooking attachment. This figure illustrates the integration of an interior mesh band onto the rim of a garment and a hook onto the other piece, allowing for the easy connection and security of the garment(s). Since there are many available holes for the hooks, due to the nature of the mesh material, this design adds to the ease of attachment.

FIG. 15 shows fabric hook 57 for use with a mesh material 81. Hook 57 is also shown for use in a hook and mesh type fastener in FIG. 11, which together can be used as a securing and/or attaching device. The fabric hook 57 which is pictured can also be made from other materials, such as wood, metal, plastic, rubber, natural and/or synthetic fibers, etc. Also, one (1) or more hook(s) 57 can be used to attach two (2) or more MGS pieces or to adjust one (1) or more MGS piece, depending whether the hook 57 and/or mesh 81 is on one (1) or more MGS piece. Said hooks can be located on the interior bottom seam or circumference of the crop top.

The mesh material 81 can be made from any material with openings which hook 57 can connect with and/or hook into. Non-limiting examples of the mesh material, including, but not limited to, fabric, appropriate metal, hemp, plastic, rubber, natural and/or synthetic fibers, etc. Also, the mesh can be of any size, as long as there is a sufficient amount for hook 57 to hook into. For example, 81*a* is a larger piece of mesh material 81 than 81*b*. The number of pieces of mesh material 81 should be consistent with the number of hooks 57 which are used. It is also possible to have the mesh material 81 extend all or part of the entire length or all or part of the entire circumference of an MGS piece. Also, the point of connection of the hook 57 and mesh material 81 can be along a vertical, horizontal, diagonal, zig-zag line, etc. of the MGS piece, similar to zipper(s) 37 and/or adhering strip(s) 77.

The hook 57 and/or mesh 81 can be placed on either or both the interior and/or exterior of one (1) or more MGS pieces. Also, either or both of the hook 57 and/or mesh 81 can be hidden by any known or obvious practical means, such as by hiding it under a flap of extra material and/or fabric, simply placing it in the interior of the MGS piece, etc. When hook 57 and/or mesh 81 are on the exterior of an MGS piece, they can have a decorative and/or ornamenting effect.

Figure 16:
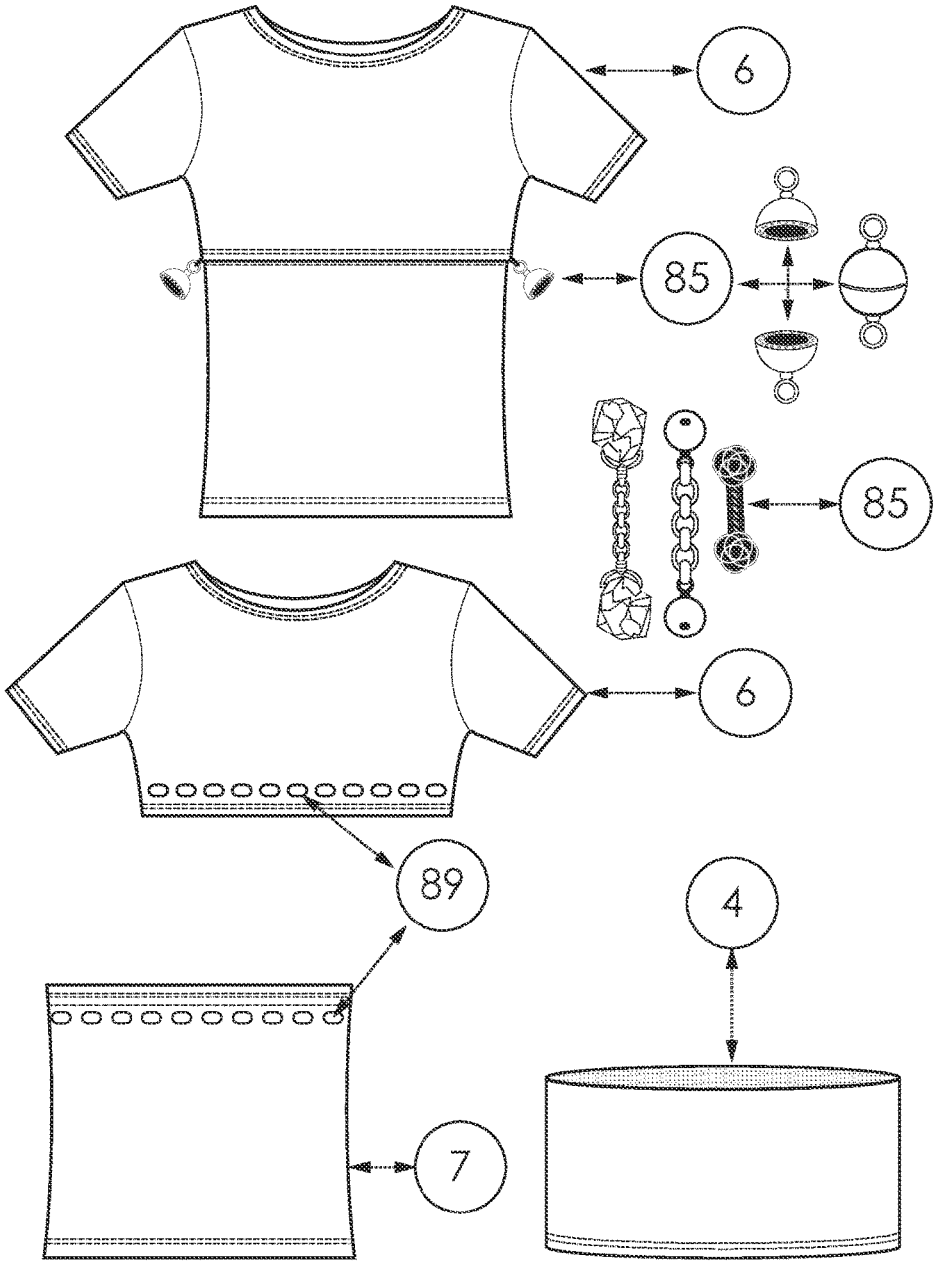
FIG. 16 depicts an embodiment of the invention utilizing magnets and charms as the attachment and/or securing device between the garments. In this embodiment magnets may be sewn into the rim of both tops for connecting the two (2) together. In another embodiment, also depicted in FIG. 16, the invention may utilize charms as the securing and/or attaching device. In order to use charms, the invention may possess holes in both pieces of the tops, and charm pieces may then latch the two tops together similar in style to a cuff link.

FIG. 16 shows attachment and/or adjustment devices 85 made of attached charms (or gems), pearls, or knots. They are similar to Cufflinks and will be referred to as such herein. Cufflinks also come in a swivel bar type, and that type would be useful as adjustment or attachment device(s) 85 as well. Additionally, a pair of connected or separate magnets can be used as adjustment or attachment device(s) 85. The adjustment or attachment device(s) 85 can be made of a variety of practical or decorative materials, such as fabric, metal, stones, enamel, wood, plastic, natural and/or synthetic fibers, nylon, etc. In FIG. 16 both of the MGS pieces have openings 89 for device 85 to be passed through. However, it is possible that device 85 can be passed through openings 89 in the same MGS piece so that it can adjust the MGS piece. The number of openings 89 is variable and just because there are a certain number of openings 89 present, it does not mean that the same number of adjustment or attachment device(s) 85 is needed. Also, the point of connection of the openings 89 can be along a vertical, horizontal, diagonal, zig-zag line, etc. of the MGS piece, similar to the placement of hook 57 and mesh 81, zipper(s) 37 and/or adhering strip(s) 77. One (1) of the nice things about using this type of adjustment or attachment device(s) 85, is that one (1) or more different cufflinks can be used for a decorative and/or ornamenting effect, that is, the cufflinks are interchangeable and/or fashionable and can create different styles and motifs for the wearer.

When two (2) separate magnets are used as adjustment or attachment device(s) 85, the presence of openings 89 is not necessary. The opposing magnet pairs can be placed on the interior and/or exterior of one (1) or more MGS pieces; they can be exposed or hidden; hidden by being covered by the material in the MGS piece itself or by an extra flap of material.

Figure 17:
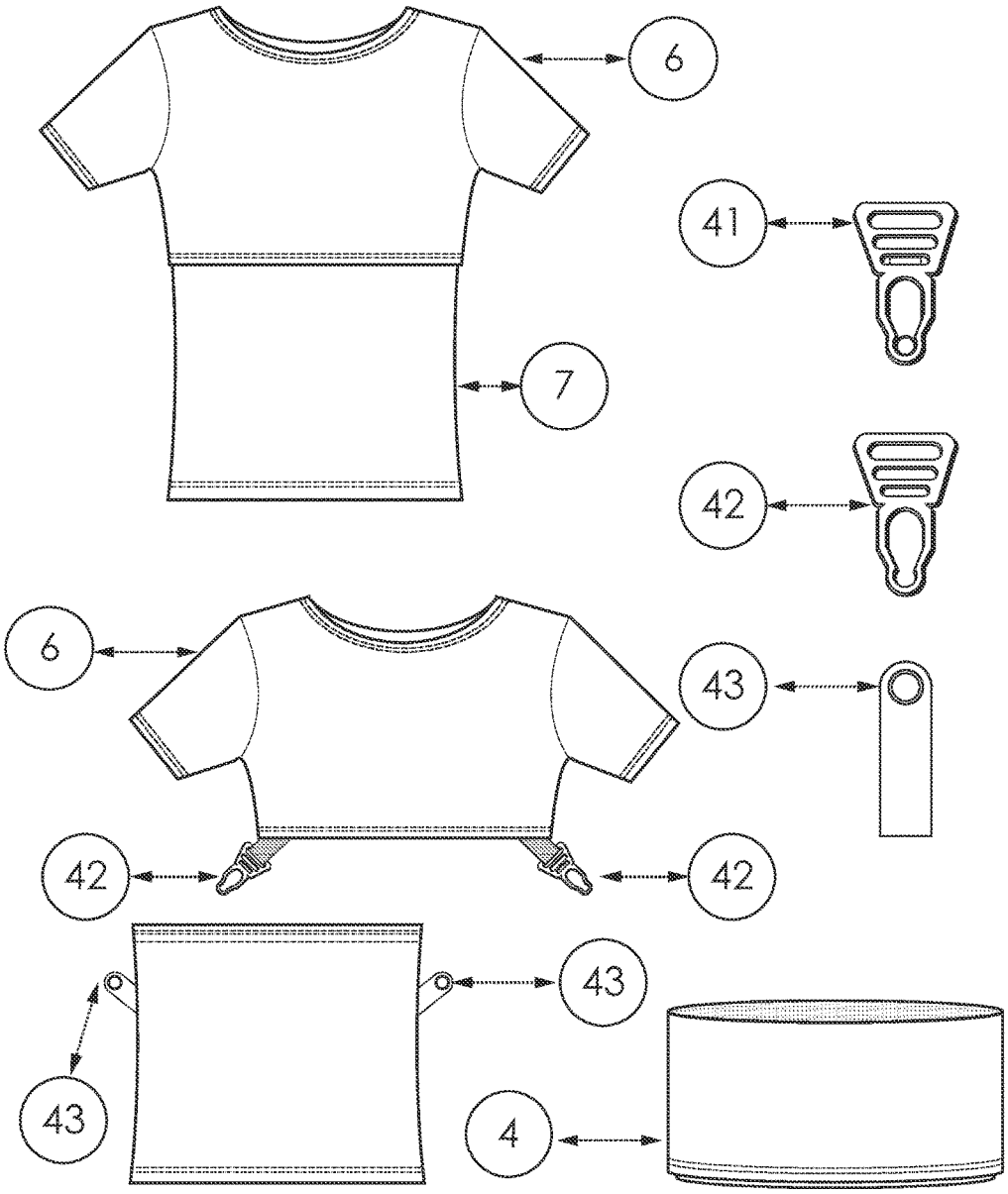
FIG. 17 depicts an embodiment of the invention in which rubber stays are utilized as the attaching and/or securing device. As depicted within this figure, in this embodiment garter-type stays with rubber buttons and connecting pieces may be used to connect the two (2) tops together. In addition, these rubber stays can be hidden in the seam of the crop and tube tops or used as fun decorative styles.

FIG. 17 shows rubber stays 41 of the type used as garter stays. They can be used the same way as the stays shown in FIG. 10 and they can be hidden inside the seams or outside as decorative.

Figure 18:
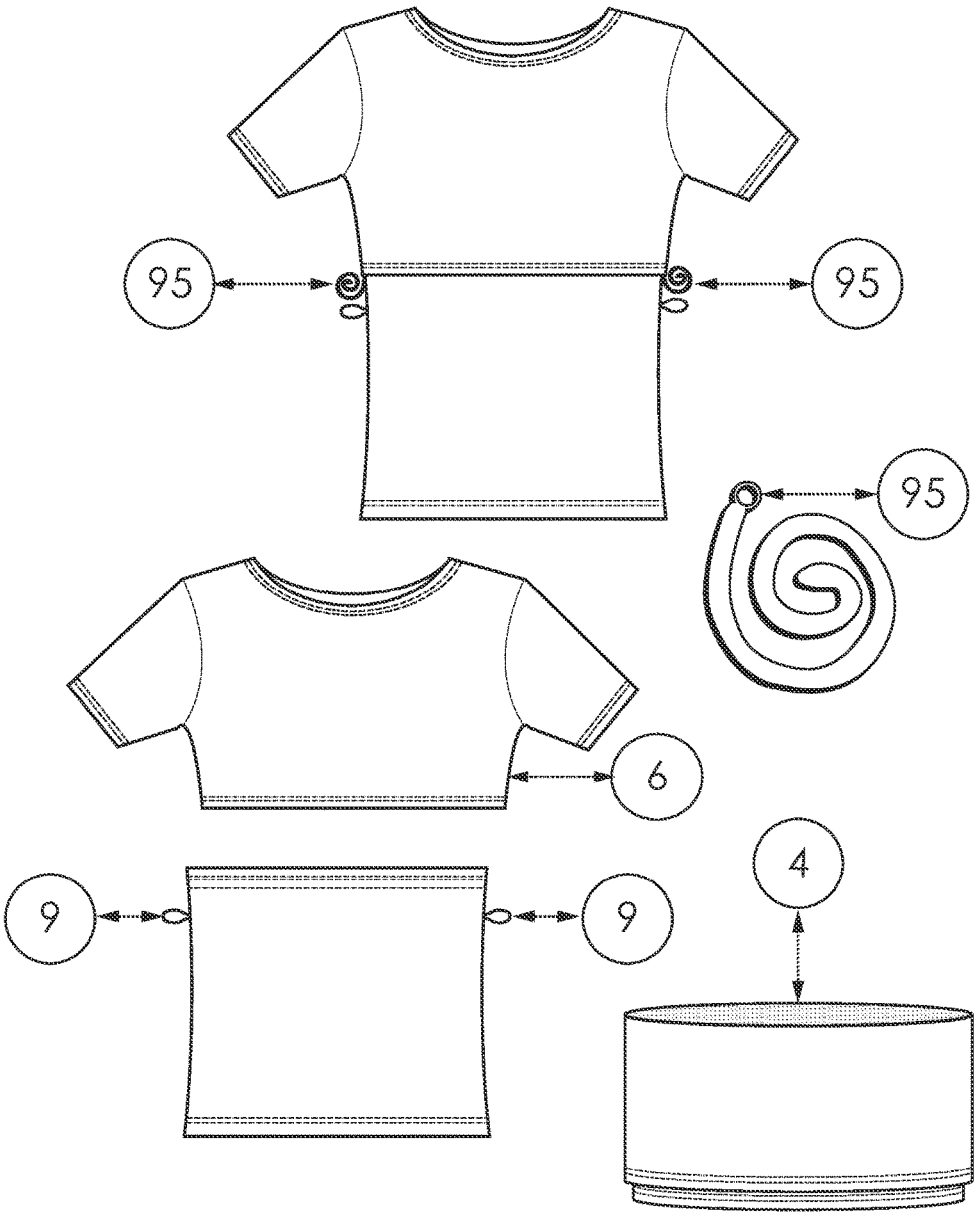
FIG. 18 depicts the ability of the present invention to utilize custom closures as securing and/or attaching devices. The custom closures depicted in this figure, such as the Swirl Curl Closure, can be used as an easy closure method by hooking onto a tiny loop on the adjacent garment that needs connecting and securing.

FIG. 18 shows an example of a custom closure attachment and/or adjustment device 95 in the form of a swirl loop fastener. Custom closure 95 can be rotated through any openings, loops, and/or other attachment and/or adjustment devices, e.g., the toggle closures 67*a* and 67*b* shown in FIG. 13, in one or more MGS pieces.

Figure 19:
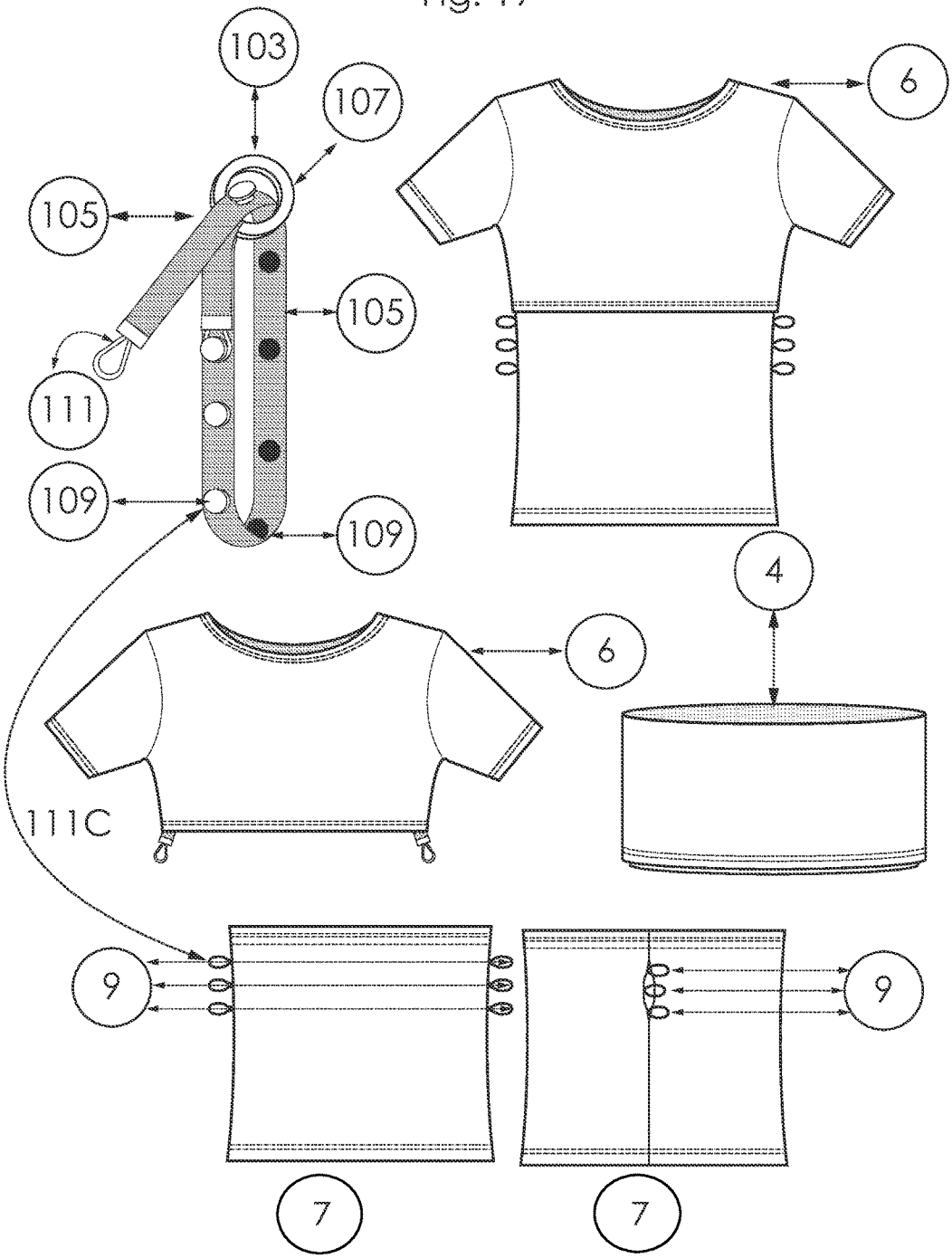
FIG. 19 depicts another embodiment of the invention wherein the invention utilizes adjustable pull through circle loop latches as securing and/or attachment devices. These adjustable pull through circle loop latches may be used as a side-connecting loop and latch, and/or a front, all-around, latching system.

FIG. 19 shows another example of an attachment and/or adjustment device as loop latch 103. In one (1) example, loop latch 103 is an adjustable, pull-through circle loop latch. In FIG. 19 the loop latch 103 is shown for use with attaching loop(s) 9, which are also shown in several other figures. One (1) or more loop(s) 9 can be used with loop latch 103 or any other attachment and/or adjustment device. In the example shown in FIG. 19, tube top MGS piece 7 has three (3) loops on both sides and crop top MGS piece 6 has two (2) loops on one (1) side. In both of the MGS pieces shown, the loops are located under the arms. However, it is possible to use one (1) or more attaching loop(s) 9 in any location on any MGS pieces and use it in connection with loop latch 103.

The loop latch 103 in FIG. 19 has several features including a strip of material 105, a circular ring 107, fastener buttons 109 and elastic loop 111. The strip of material 105 can be a ribbon-like fabric, as shown in FIG. 19, or any other suitable material, such as flexible material, rubber, nylon, plastic, natural and/or synthetic fibers, etc. The circular ring 107 can be metal, as shown in FIG. 19, or any other suitable material, such as rubber, wood, plastic, elastic, nylon, natural and/or synthetic fibers, etc. The fastener buttons 109 can be any type of hardware loop 111 can attach to, such as studs, snaps, posts, etc. And the fastener buttons 109 can be made of rubber, wood, plastic, elastic, nylon, natural and/or synthetic fibers, etc., in addition to the metal and/or metal-like buttons shown in FIG. 19. Elastic loop 111*c* can be any type of hardware that can be attached to fastener buttons 109, such as loops of any other suitable material, such as, fabric, rubber, wood, plastic, elastic, nylon, natural and/or synthetic fibers, etc., or cap-shaped fasteners of any suitable material, such as, rubber, wood, plastic, elastic, nylon, natural and/or synthetic fibers, etc., or a stay-shaped fastener, like stay 41 in FIG. 10, of any suitable material, such as rubber, wood, metal, plastic, elastic, nylon, natural and/or synthetic fibers, etc., and other types of hardware.

One (1) or more loop latches 103 can be used to adjust and/or attach one (1) or more MGS pieces. The loop latch 103 is versatile and can be used in a number of different ways. By way of non-limiting example, the strip of material 105 can be threaded through one or more loop(s) 9 on one or more MGS pieces, threaded through circular ring 107 and loop 111 can be attached to fastener 109.

As with any of the adjustment or attachment devices can be hidden, by any known or obvious practical means, e.g., under a flap of fabric. Adjustments can also be made using attachment devices on the same or another MGS piece. Also, attachments can be made using adjustment devices.

Figure 20:
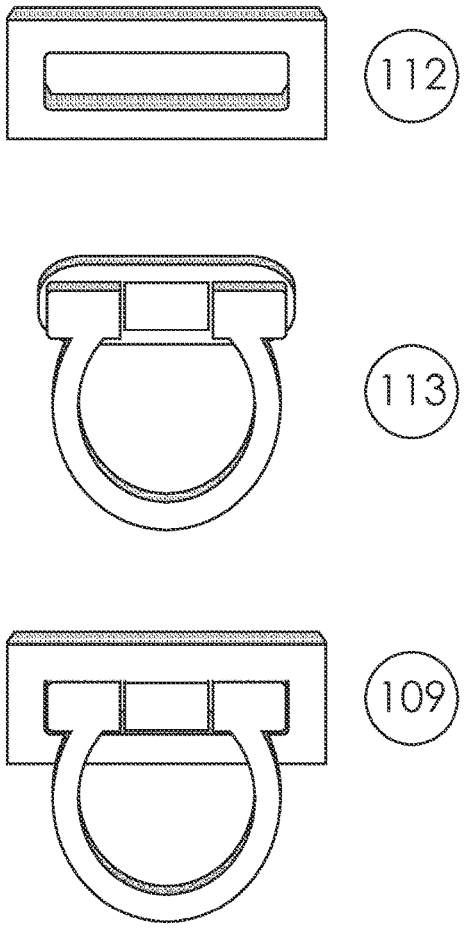
FIGS. 20(*a-c*) depict another embodiment of the present invention wherein the invention utilizes a buckle with a pivotal, and/or hinged, male and female end, which interlock to form the attaching and/or securing device.
Figure 20:
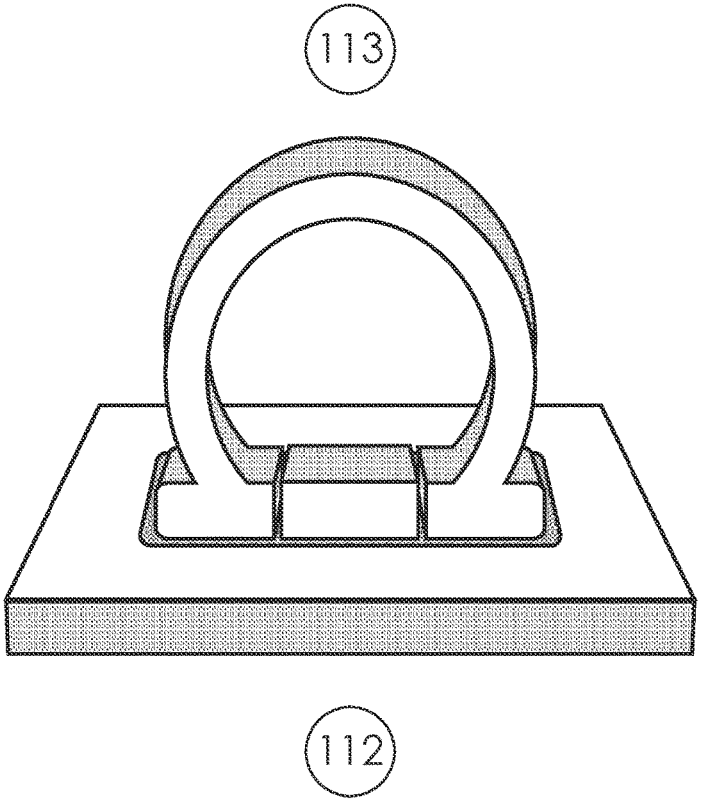
Figure 20:
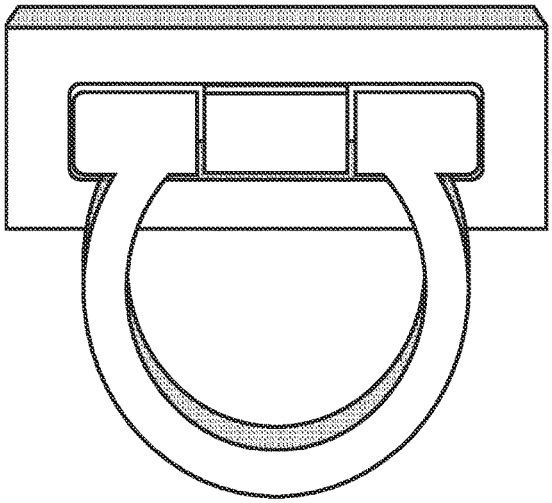

Another example of an attaching and/or securing device is shown in FIGS. 20(*a-c*) whereby at least one (1) female buckle 112 coordinates with at least one (1) other hinged and/or pivotal male piece 113 and in which the two (2) pieces are capable of removably interlocking with one another.

Figure 21:
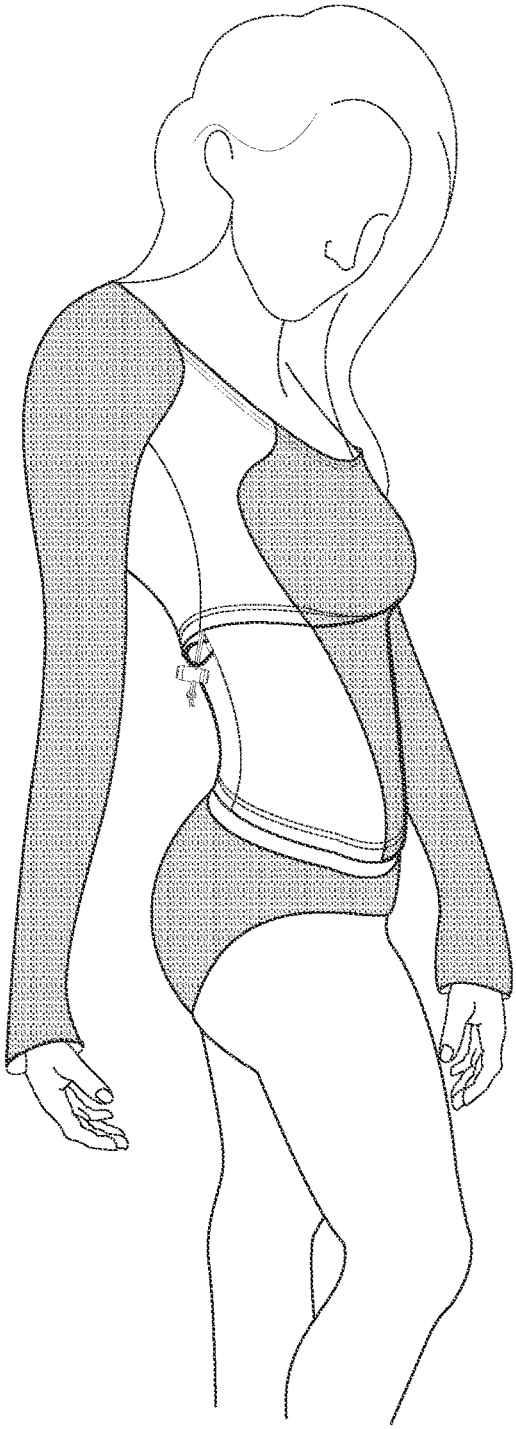
FIG. 21*a* shows a wearer wearing a crop top and tube top.
FIGS. 21*b* and 21*c* show the wearer having removed the crop top and attached it only to the back area of her body.
FIGS. 21*d*-21*k* feature additional depictions of the present invention in use by a wearer.
Figure 21:
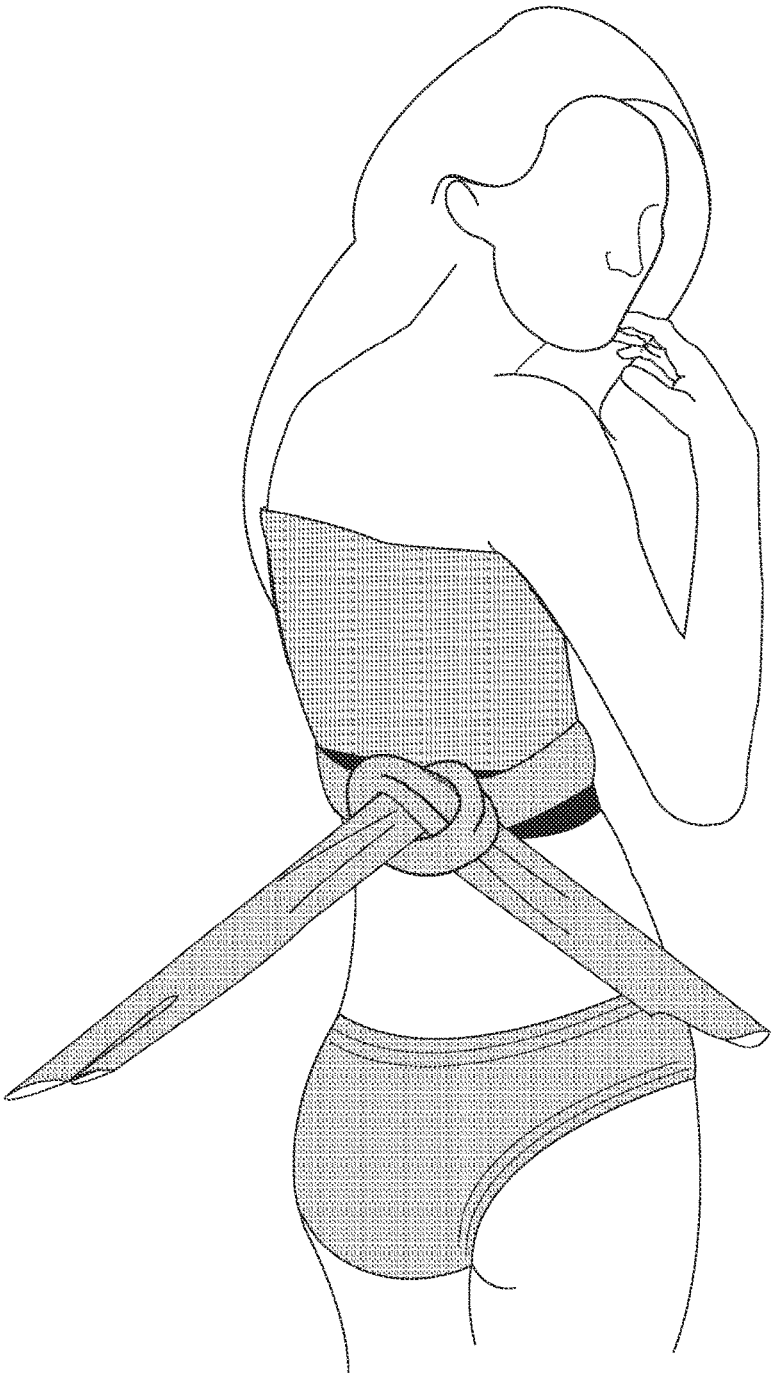
Figure 21:
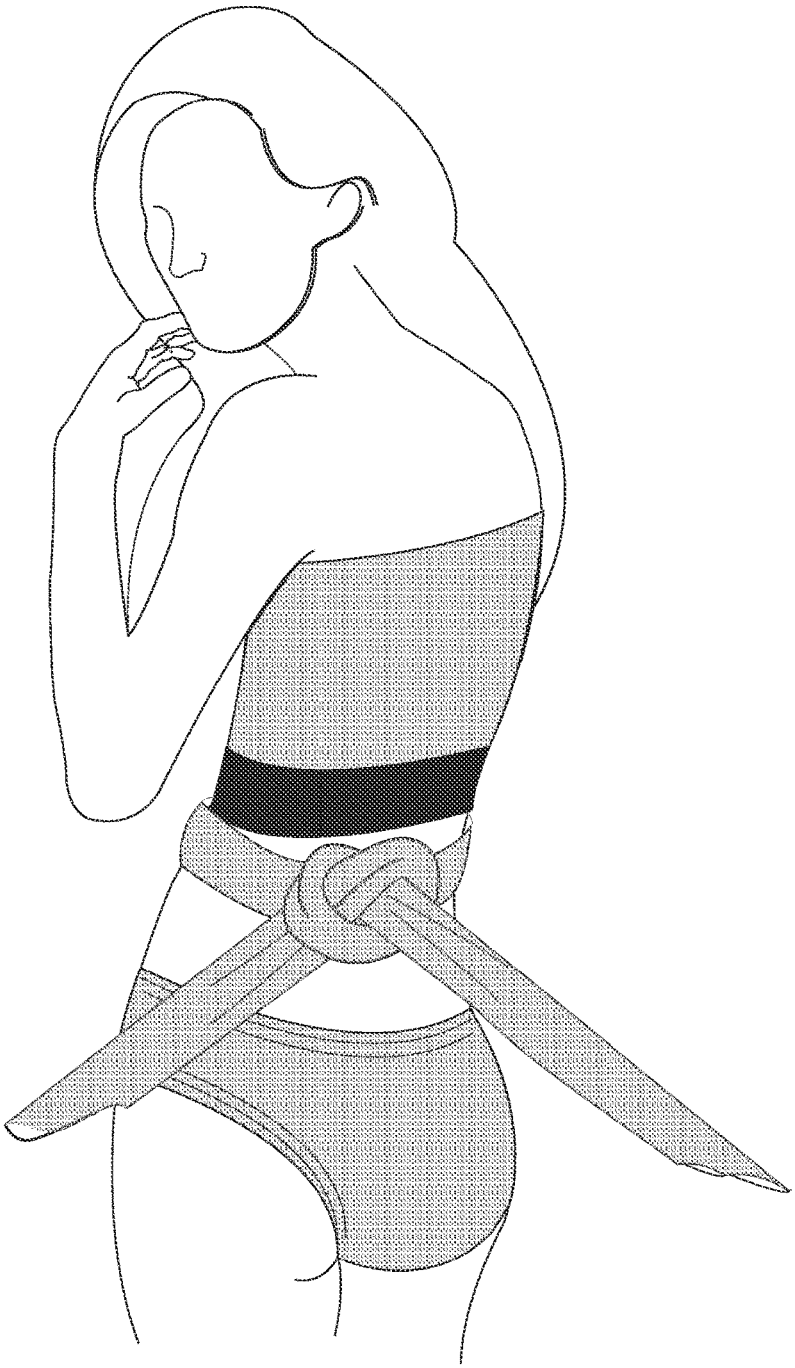
Figure 21:
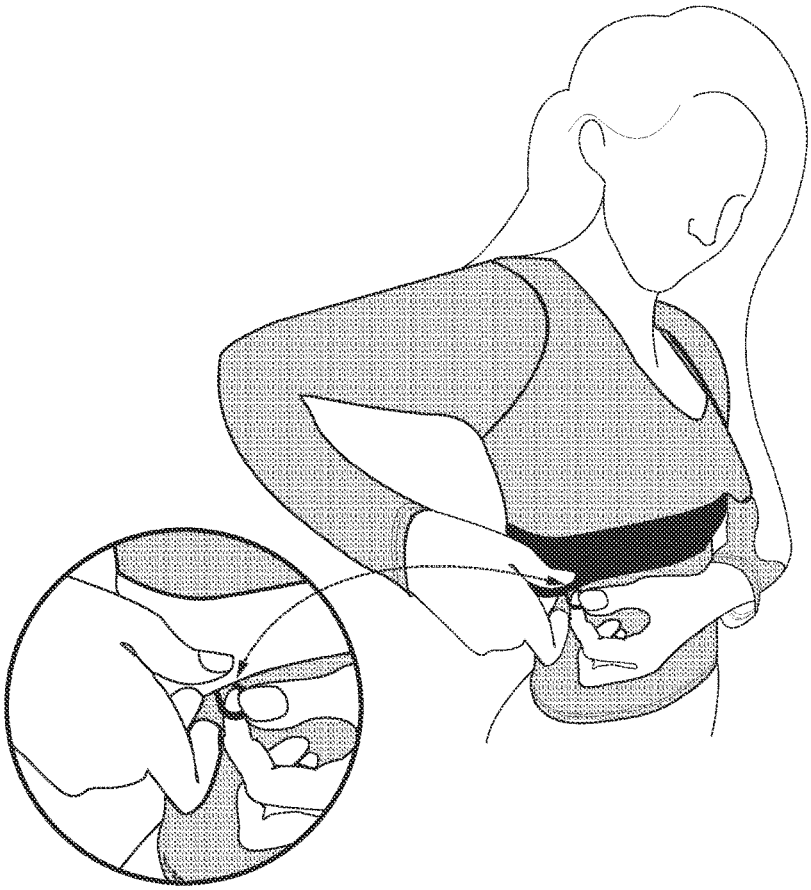
Figure 21:
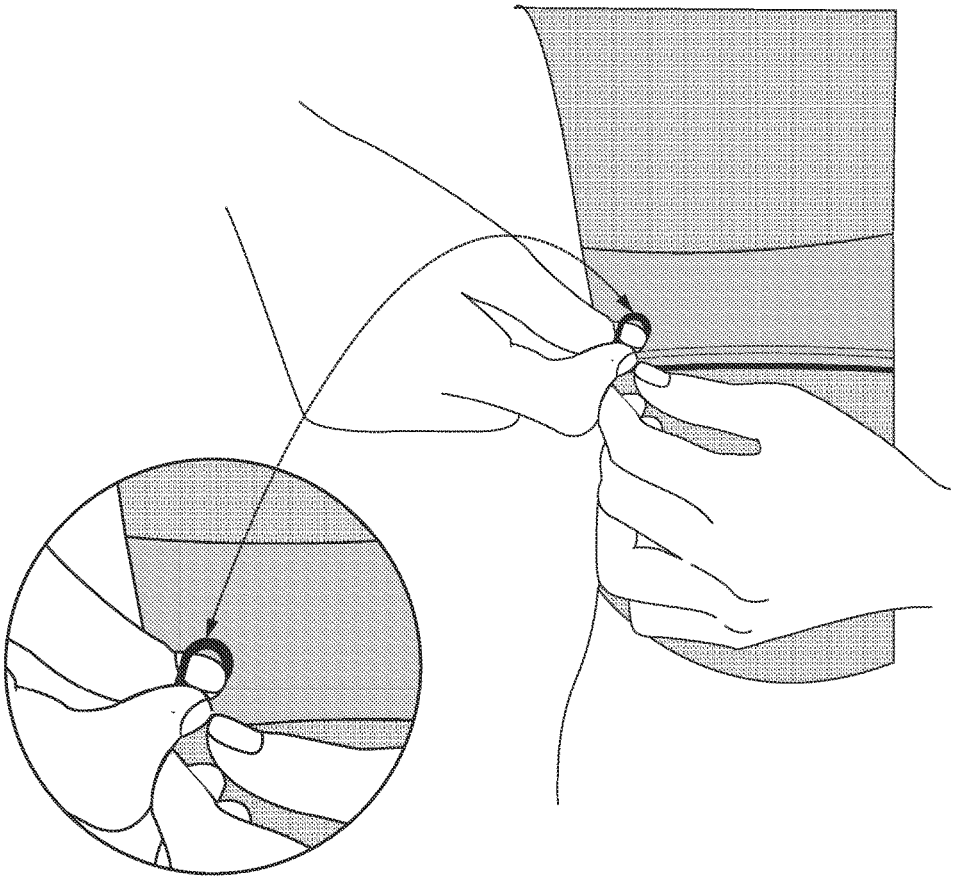
Figure 21:
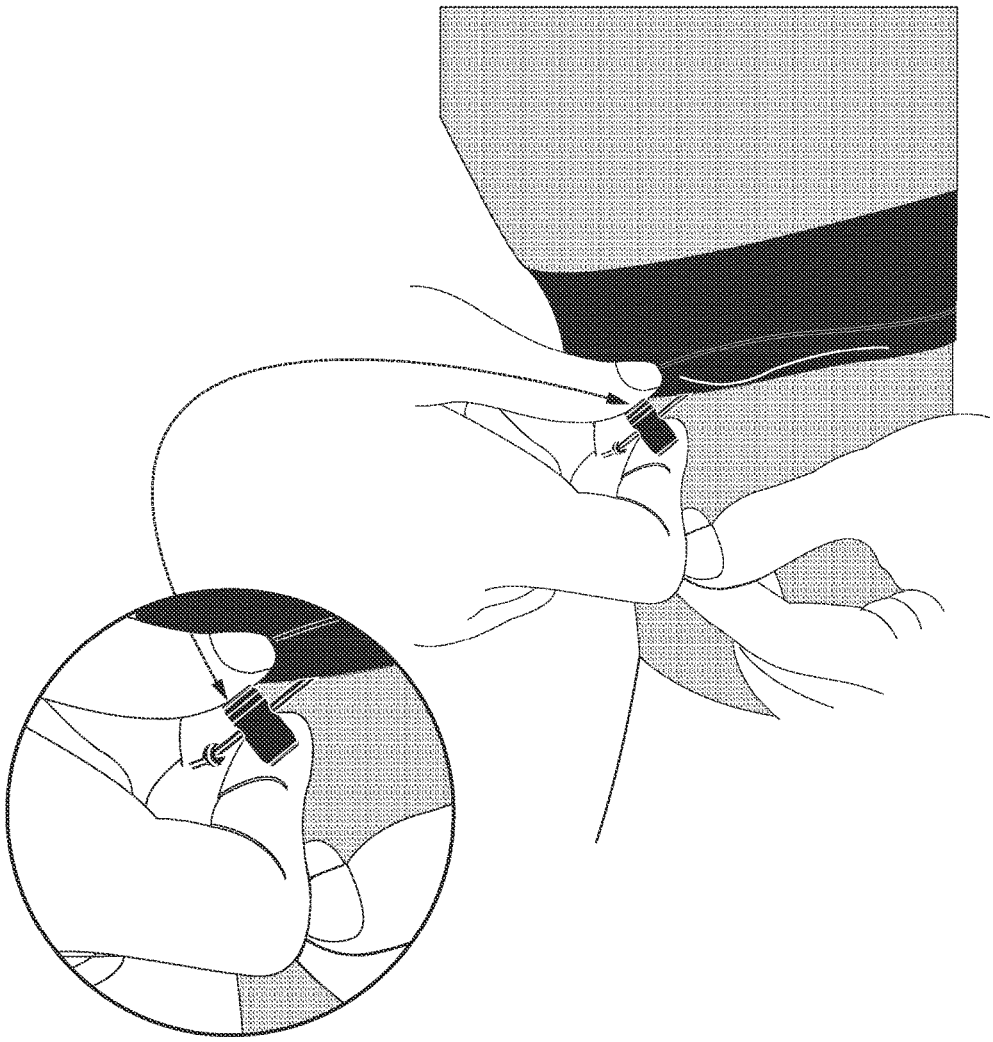
Figure 21:
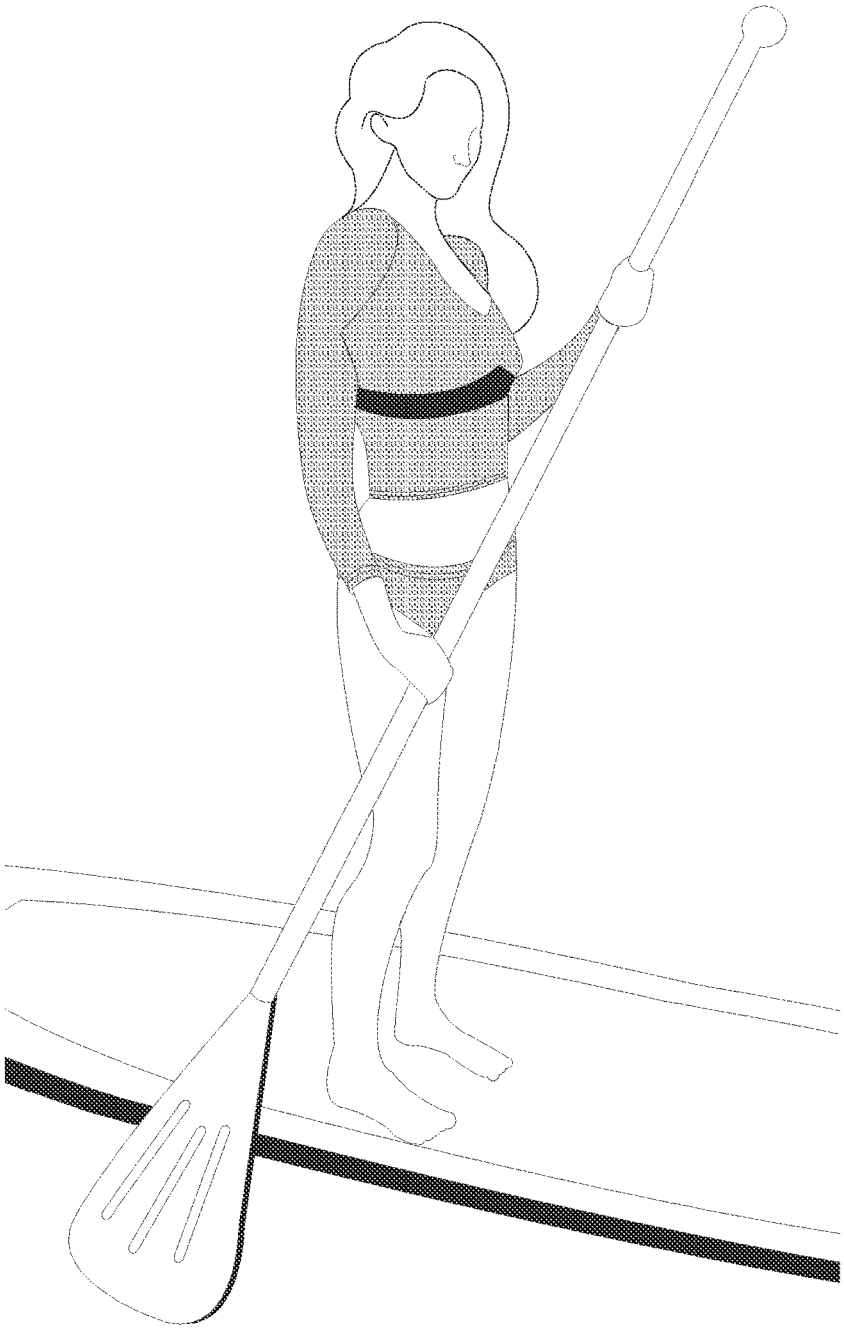
Figure 21H:
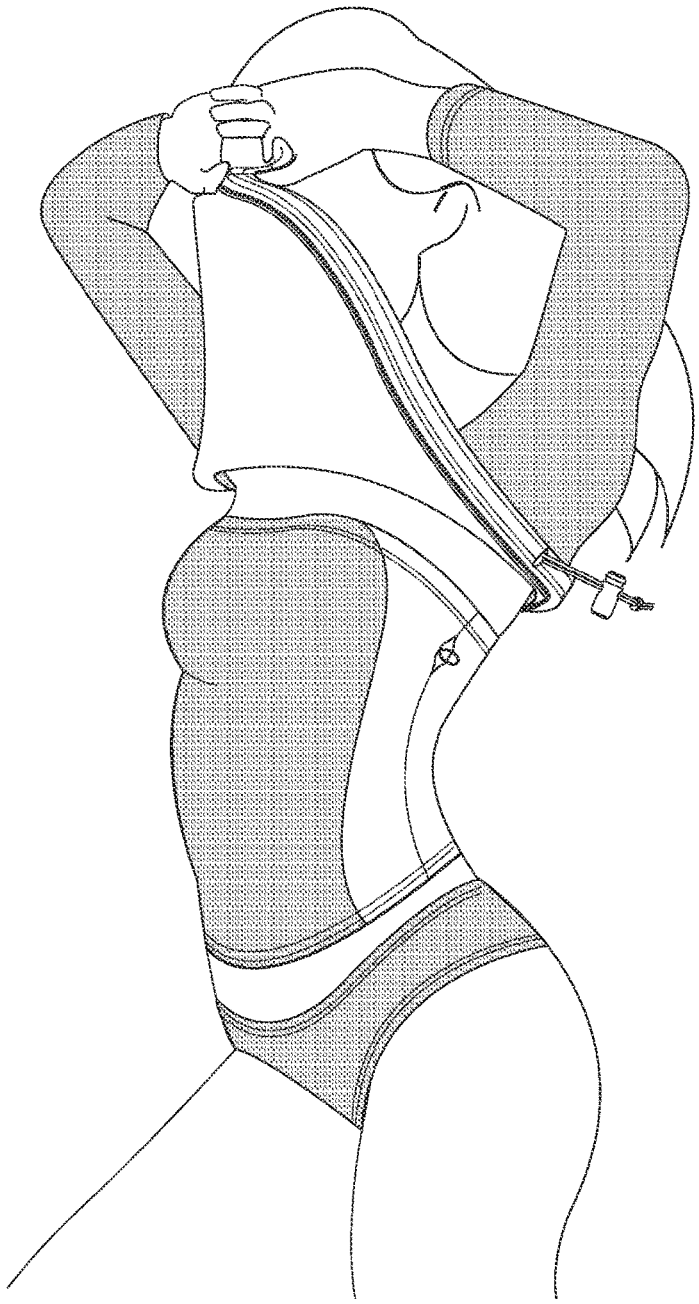
Figure 21I:
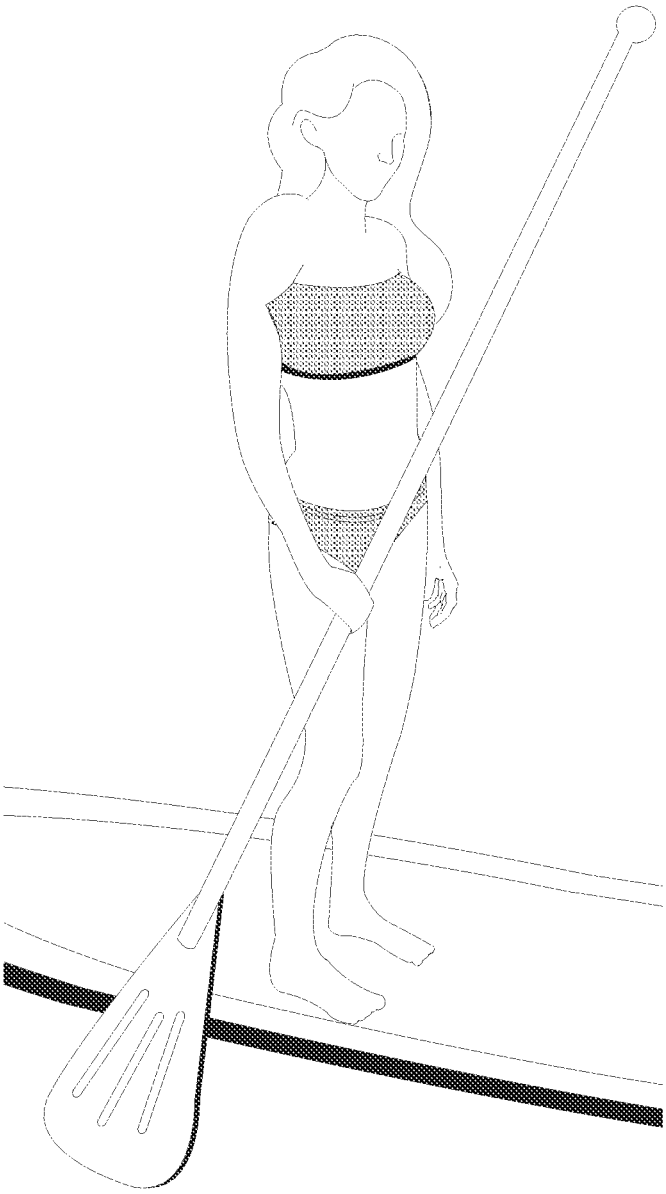
Figure 21J:
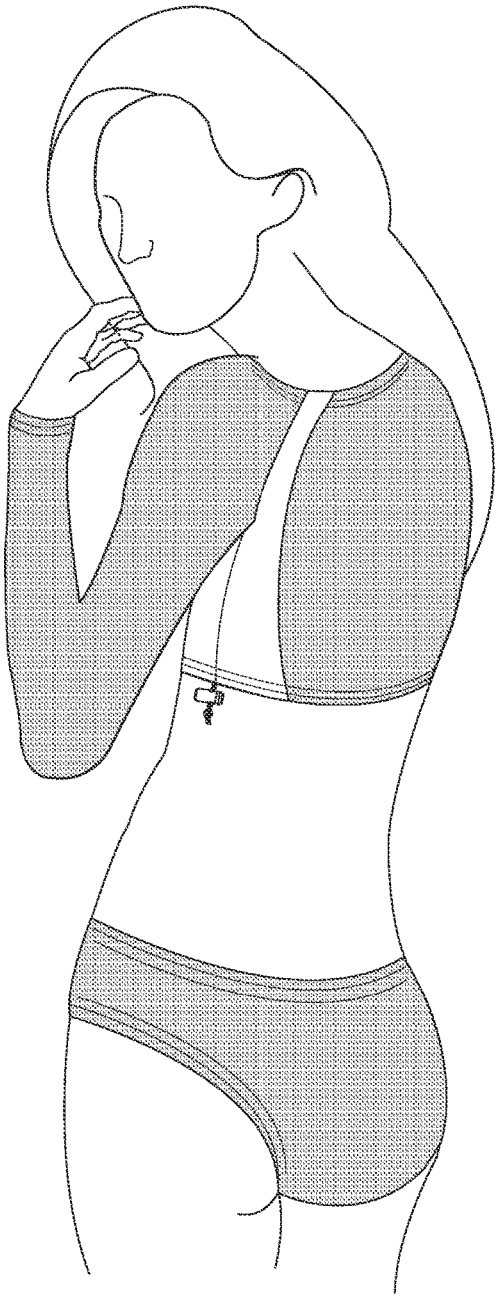
Figure 21K:
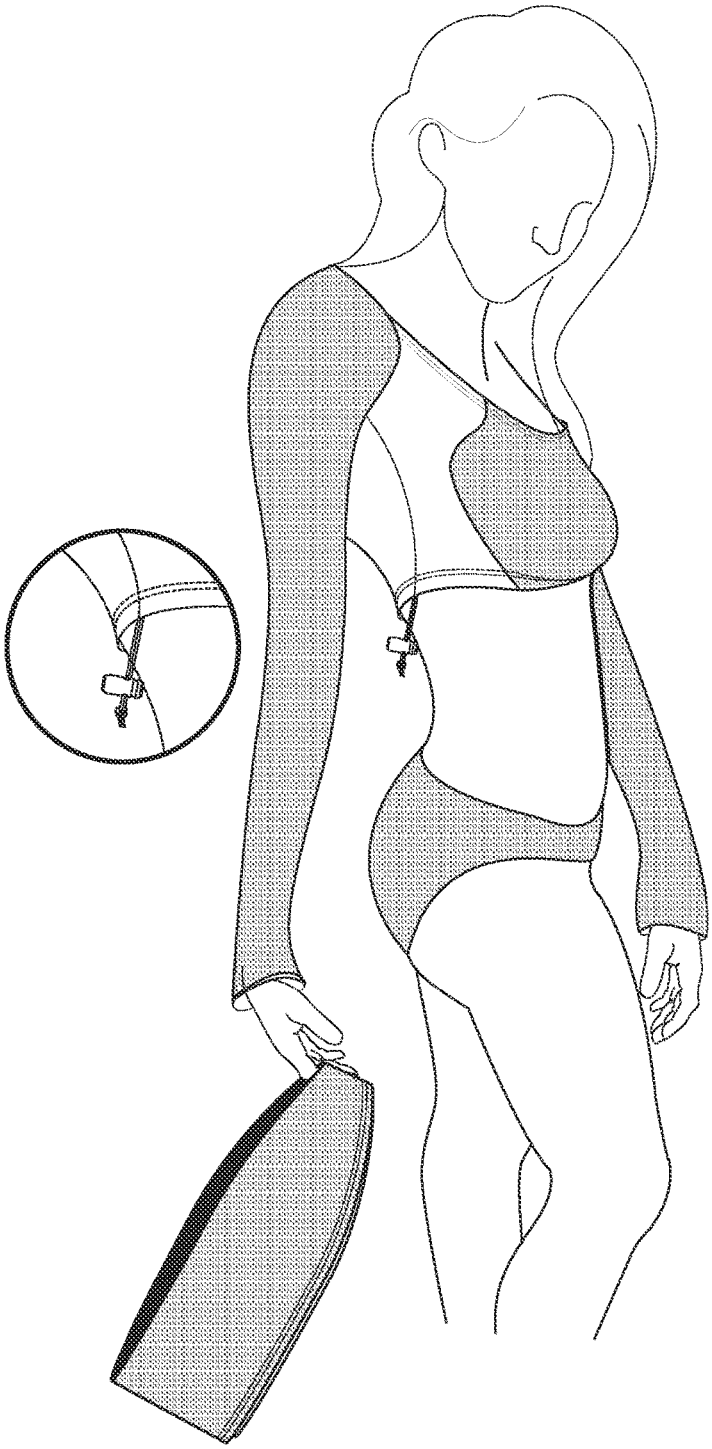

FIG. 21*a* shows the wearer, wearing a crop top and tube top.

FIGS. 21*b* and 21*c* show the wearer having removed the crop top and attached it to only the back area of her body.

FIGS. 21*d* through 21*k* feature additional depictions of the present invention in use by a wearer.

The multifunctional garment system can have a first piece and at least one (1) or more additional pieces, both the first piece and at least one (1) additional piece hang from the upper body of the wearer, the first piece overlays at least a portion of the at least one (1) additional piece, the at least one (1) adjusting and/or tightening device is in at least one (1) of the bottom section and/or the top section of the first piece, and the at least one (1) attaching device is on and/or in the first piece.

The multifunctional garment system can have a first piece and at least one (1) or more additional pieces, the at least one (1) additional piece does not hang from the waist area of a wearer, and/or further comprising at least one (1) additional securing device on at least one (1) of the first piece and/or one (1) or more additional pieces.

NO(S). IN FIGURES

1 securing device
3 securing device
4 bandeau top
5 connection of securing strap
6 crop top
7 tube top
9 attaching loop
10 light drawstring
12 dark drawstring
14 drawstring lock
15 transparent material
17 elastic cord
19 dashed lines
23 plastic clips
25 plastic clips connected
27 plastic buckle
28 male buckle end
29 female buckle end
33 attaching clip
34 non-clamping end of attaching/adjusting clip
35 clamping end of attaching/adjusting clip
37 zipper(s)
41 stay(s)
42 non-clamping end of attaching/adjusting stay
43 clamping end of attaching/adjusting stay
49 material with openings
53 metal hook
57 fabric hook
61 openings
63 brad
**67*a*** toggle closure
**67*b*** toggle closure
71 toggle
77 adhering strip(s)
81 mesh
85 cufflinks
89 openings
95 custom closure
103 loop latch
105 strip of material
107 circular ring
109 fastener buttons
111 elastic loop

DEFINITIONS

"Body Parts"—various parts of the body, including but not limited to the head, neck, chest, midriff, arms, hands, waist, hips, legs feet, or parts of one or more of such body parts.

"Cufflinks"—two buttons or button-like parts connected with a chain or shank that passes through openings in one or more materials to adjust or attach the same. Also, a swivel bar-type cufflink in which the bar is passed through openings in one or more materials to adjust or attach the same. Part of the bar is swiveled perpendicularly to the remainder of the bar to operate as a toggle.

"Toggle"—including, but not limited to, a pin, rod, or crosspiece fitted or inserted into a loop in a rope, chain, or strap to prevent slipping, to tighten, or to hold an attached object.

"Lingerie"—including, but not limited to, an MGS piece, brassiere, underwear, panties, g strings, clothing that is worn in bed, woman's intimate apparel.

"Drawstring"—including, but not limited to, cord, material, elastic, elastic cord, elastic material "Drawstring Lock"—including, but not limited to, knot, barrel, wheel, spring-loaded drawstring lock, locking wheel, knot, barrel lock, toggle, and/or includes and/or is the at least one attaching device.

"Big Loops"—loops which are large enough to traverse the circumference of the body part being covered, ornamented, etc., by the MGS piece having one or more drawstrings within.

"Waist Area"—is defined as at the waist and/or above or below the waist, regardless of how it is otherwise defined herein.

"Crop Top"—is defined as a top having any length of sleeve, such as short, long, cap, ¾, off the shoulder, dolman, straps, spaghetti straps, etc., and having a length above the waist, above the navel, above the rib cage and/or below the breasts, and could be designed as loose flounce and/or tight to the body, and/or tight fit to the torso, regardless of how it is otherwise defined herein.

While the instant invention has been shown and described in accordance with preferred and practical embodiments thereof, it is recognized that departures from the instant disclosure are contemplated within the spirit and scope of the present invention. Therefore, the true scope of the invention should not be limited since other modifications will become apparent to those skilled in the art upon a study of the drawings, descriptions, explanations, and specifications herein.

What is claimed:

1. A protective multifunctional, multi garment system for wear as a single or multigarment configuration while providing a secure placement of the multigarment system against the wearer's body preventing unwanted movement of the one or more garments thereby avoiding skin and breast exposure while also providing sun protection of the wearer; said garment system comprising:

a first garment worn alone as a first configuration or as a second configuration as a first garment combined with one or more additional garment(s);

the said multifunctional, multigarment system when in said second configuration provides said additional garments as being situated in at least one of the following configuration positions relative to the said first garment as being any of adjacent, under, behind, on top of the said first garment, and/or touching the said first garment;

B) at least one adjusting tightening device in at least one of the said bottom section and/or the top section of the said first garment;

whereby at least one of the first garment and/or the one or more additional garments are drawn in tighter to the torso and are adjusted to fit a wearer's body for the purpose of keeping the garment secure against the wearer's body preventing unwanted movement and exposure;

C) at least one first attaching securing device, located on or in the first garment, or at least one first attaching securing device located on or in the first garment, and at least one second attaching securing device located on the said one or more additional garments if present which is used for attaching securing the first garment to one or more additional garments; and the said first garment alone, or the said first garment and the said one or more additional garments, being capable of being worn on or around wearer's torso wherein any one or more of the said first garment and/or the said one or more additional garments is constructed of a material having a sun protection factor rating for preventing sunburn damage to said wearer.

2. The multifunctional, multigarment system of claim 1, wherein the said first garment is a crop top and the said one or more additional garments is at least one of the following: torso top, t-shirt, long sleeved shirt, tank top, tube top, bandeau top, vest, or shirt.

3. The multifunctional, multigarment system of claim 1, wherein the said first garment and/or the said one or more additional garments includes as part of its material composition at least one of the following materials: Elastic, Polyamide, Nylon, Neoprene or Spandex.

4. The multifunctional, multigarment system of claim 1, wherein:

the said at least one tightening adjusting device is a drawstring, elastic cord or a toggle located on a elastic cord drawn tight against a wearer's torso and secured through a loop to lock it in place and prevent it from sliding or loosening, wherein;

when the said at least one tightening adjusting device is a drawstring, the at least one drawstring having at least one drawstring locking device used to maintain the drawstring in a drawn position; and when the said at least one tightening adjusting device is a drawstring, the at least one drawstring is woven into the bottom/top section of the first garment and/or the at least one drawstring is hemmed into the bottom/top section of the first garment.

5. The multifunctional multi garment system of claim 4, wherein the said at least one tightening adjusting device is the said at least one drawstring and, the said at least one drawstring is elastic.

6. The multifunctional multi garment system of claim 4, wherein the said locking device is one of: a spring loaded drawstring lock, knot, barrel lock, toggle, or is the said at least one attaching securing device.

7. The multifunctional multi garment system of claim 1, wherein the said at least one attaching securing device is a toggle, zipper, zipper pull, Velcro® fastener, hook and loop fastener, hook and eye, snap, button, buckle, clip, clasp, hook and mesh, magnet or a, full through circle slip latch lock; and wherein the at least one attaching securing device is at any of the front, back, one or more sides, one or more locations, and/or on the entire length or diameter or circumference or area of the top section and/or bottom section of the first garment and/or the one or more additional garments when included in the multigarment configuration.

8. The multifunctional multi garment system of claim 1, wherein the multifunctional multi garment system has a first garment and one or more additional garments, the at least one attaching securing device is on and/or in the first garment; and further comprising at least one attaching securing device on and/or in at least one of the one or more additional garments; and the at least one attaching securing device on and/or in the first garment, and the at least one attaching securing device on and/or in at least one of the one or more additional garments are mateable to each other.

9. A method of using a multifunctional multi garment system comprising:

applying a first garment alone as a first configuration, or as a second configuration a first garment and one or more additional garments, to a wearer's body or a part thereof, the one or more additional garments being situated adjacent and/or touching, etc. the first garment; the first garment and the one or more additional garments having at least a top section, if present, located at or near the top thereof, and a bottom section, located at or near the bottom thereof;

tightening and/or adjusting at least one tightening and/or adjusting device in at least one of the bottom section and/or the top section of the first garment and/or the one or more additional garments, whereby at least one of the bottom section and/or the top section of the first garment and/or the one or more additional garments can be adjusted and/or drawn in tighter to the wearer's body; and when the first garment and the one or more additional garments have been applied to the wearer's body or a part thereof, attaching at least one attaching securing device, located on or in the first garment and/or on or in the one or more additional garments, to the first garment or the one or more additional garments.

10. The method of claim 9, wherein the first garment and/or the one or more additional garments is applied on and/or around one or more parts of the wearer's body, chest and/or upper body, midriff, hips, arms, neck, head or part thereof or extending past that area that it's on or around torso or bottom half.

11. The method of claim 9, further comprising the detaching, loosening, and removing of the said first garment and the said one or more additional garments.

12. The method of using a multifunctional garment system of claim 9, wherein the said first garment is a crop top and the said one or more additional garments is at least one of the following: of a t-shirt, long sleeved shirt, tank top, tube top, bandeau top, vest or, shirt.

13. The method of claim 9, wherein:

the said at least one tightening adjusting device is a drawstring, elastic cord or a, toggle located on an elastic cord drawn tight against a wearer's torso and secured through a loop to lock it in place and when the at least one tightening device is a drawstring, the at least one drawstring having at least one drawstring locking device which can be used to maintain the drawstring in a drawn position; and when the at least one tightening device is a drawstring, the at least one drawstring is woven into the bottom section of the top garment or hemmed into the bottom section of the top garment.

14. The method of claim 13, wherein the said at least one tightening adjusting device is at least two drawstrings and at least one of the said at least two drawstrings has a locking device for each drawstring.

15. The method of using a multifunctional garment system of claim 14, wherein the locking device is any one of a spring loaded drawstring lock, locking wheel, knot, barrel lock and toggle.

16. The method of using a multifunctional garment system of claim 9, wherein the at least one attaching securing device is any of a drawstring, an elastic, toggle, zipper and zipper pull, loop, hook and loop fastener, material having complimentary parts which mate to each other when pressed together, hook and eye, hook, snap, button, buckle, clip, clasp, stud, mesh, magnet, stay, twist tie, adjustable pull through circle loop latch and/or brad; and wherein the at least one attaching securing device is at the front, back, one (1) or more sides, one or more locations, along the entire length of the top section and/or bottom section of the first garment and/or the one or more additional garments.

17. The method of using a multifunctional garment system of claim 9, wherein the multifunctional garment has a first garment and one or more additional garments, the at least one attaching securing device is on and/or in the first garment;

further comprising at least one attaching securing device on and/or in the one or more additional garments; and the at least one (1) attaching securing device on and/or in the first garment, and the at least one (1) attaching securing device on and/or in the one (1) or more additional garments mateable to each other.

18. The multifunctional garment system of claim 4, wherein the said at least one tightening adjusting device is at least two drawstrings and at least one of the said at least two drawstrings has a locking.

19. The method of claim 9, wherein the said first piece and/or the said one or more additional garments is constructed of a swimwear material including an Elastic, Polyamide, Nylon, Neoprene or Spandex material or combinations thereof and wherein any one or more of the said first piece and/or the said one or more additional garments is of a material having a sun protection factor rating for preventing sun burn damage to said wearer.

* * * * *